US006000894A

United States Patent [19]

Suzuki et al.

[11] Patent Number: 6,000,894

[45] Date of Patent: Dec. 14, 1999

[54] BOOKBINDING APPARATUS

[75] Inventors: Katsunari Suzuki, Kawasaki; Hideto Kohtani; Daisuke Ishizuka, both of Yokohama, all of Japan

[73] Assignee: Canon Kabushiki Kaisha, Tokyo, Japan

[21] Appl. No.: 08/674,757

[22] Filed: Jul. 2, 1996

[30] Foreign Application Priority Data

Jul. 4, 1995 [JP] Japan ..... 7-169001

[51] Int. Cl.[6] ..... B42C 9/00; B65H 43/08

[52] U.S. Cl. ..... 412/11; 270/32; 270/52.18; 412/27; 412/33; 412/37; 412/900; 412/902

[58] Field of Search ..... 412/8, 9, 11, 12, 412/27, 33, 37, 900, 902; 227/2, 3, 4, 5, 6, 7; 270/32, 37, 52.18

[56] References Cited

U.S. PATENT DOCUMENTS

| | | | |
|---|---|---|---|
| 1,986,923 | 1/1935 | Eastman | 227/4 |
| 3,928,119 | 12/1975 | Sarring | 412/900 X |
| 3,953,277 | 4/1976 | Kuhns | 412/11 X |
| 5,441,374 | 8/1995 | Kosanke et al. | 412/11 |
| 5,464,201 | 11/1995 | Deen et al. | 227/5 |
| 5,569,011 | 10/1996 | Yamaguchi et al. | 412/33 X |
| 5,569,012 | 10/1996 | Kosasa et al. | 412/33 |

*Primary Examiner*—Paul A. Bell
*Attorney, Agent, or Firm*—Fitzpatrick, Cella, Harper & Scinto

[57] ABSTRACT

A binding apparatus is provided with a tape reel on which a bind tape of a small tape width size is wound, and a tape reel on which a bind tape of a large tape width size is wound. When the tape reels and are set, the width size of each bind tape is read by means for detecting a width size discrimination mark (ring) formed on each tape reel and is memorized by width size memory means. The thickness of a bundle of sheets is measured by the use of a clamp member for clamping the bundle of sheets aligned on an aligning tray, and is memorized by thickness memory means. A bind tape of a tape width size corresponding to the thickness memorized by the thickness memory means is selected from among the sizes memorized by the width size memory means, and a carriage is moved to the tape reel on which a bind tape of the same size is wound.

8 Claims, 26 Drawing Sheets

BOOKBINDING APPARATUS

BACKGROUND OF THE INVENTION

1. Field of the Invention

This invention relates to a bookbinding apparatus for automatically binding a bundle of sheets.

2. Related Background Art

There is known an on-line apparatus which continuously effects from the image formation on sheets to the work of binding the sheets having images formed thereon, by a series of flows. This on-line apparatus adopts a method of pasting and binding a plurality of sheets (a bundle of sheets) having images formed thereon. In this pasting and bookbinding, use is made of a strip-like bind tape to which a hot melt adhesive agent is applied.

When sheets having images formed thereon which are moving in the on-line apparatus are to be bound, the sheets having images formed thereon which are moving are first stacked on an aligning tray and are aligned thereon. A bind tape cut into a strip-like form is then disposed on the bound edge of the bundle of sheets aligned, and subsequently the bind tape is heated by a heater to thereby melt a hot melt adhesive agent. The melted hot melt adhesive agent flows among the sheets and pastes the bundle of sheets. In this case, right and left side heaters bend the right and left side portions of the bind tape and adhesively secure them to the front and back covers of the bundle of sheets.

The on-line apparatus according to the prior art is provided with one kind of tape-up bind tape having a particular width size, and this take-up bind tape is cut into a predetermined length and supplied to a bookbinding portion. In this case, a bind tape having a width size suitable for the thickness of a bundle of sheets to be bound is chosen by an operator and is set in the on-line apparatus.

However, if as in the above-described example of the prior art, only one kind of bind tape can be supplied, the work of changing the bind tape to be used each time the thickness of a bundle of sheets to be bound changes must be done by the operator. This has led to much labor and time and to the problem that depending on the thickness of a bundle of sheets to be bound, the length of the margin to paste up adhesively secured to the front and back covers of the bundle of sheets becomes irregular and the quality of bookbinding is spoiled.

SUMMARY OF THE INVENTION

The present invention has as its object to provide a bookbinding apparatus designed to automatically select and supply a bind tape of a width size conforming to the thickness of a bundle of sheets to be bound.

The present invention is a bookbinding apparatus for binding a bundle of sheets by the use of a bind tape, characterized by a plurality of bind tape supporting means for supporting a plurality of kinds of bind tape differing in tapes width size, width size information output means for outputting the information of the width size of the bind tape supported by each of said bind tape supporting means, thickness information output means for outputting the thickness information of a bundle of sheets to be bound, tape selecting means for selecting a bind tape of an optimum size capable of binding the bundle of sheets on the basis of the information from said width size information output means and said thickness information output means, and binding means for binding the bind tape selected by said tape selecting means and said bundle of sheets together.

DESCRIPTION OF THE PREFERRED EMBODIMENTS

An embodiment of the present invention will hereinafter be described with reference to the drawings.

Figure 1:
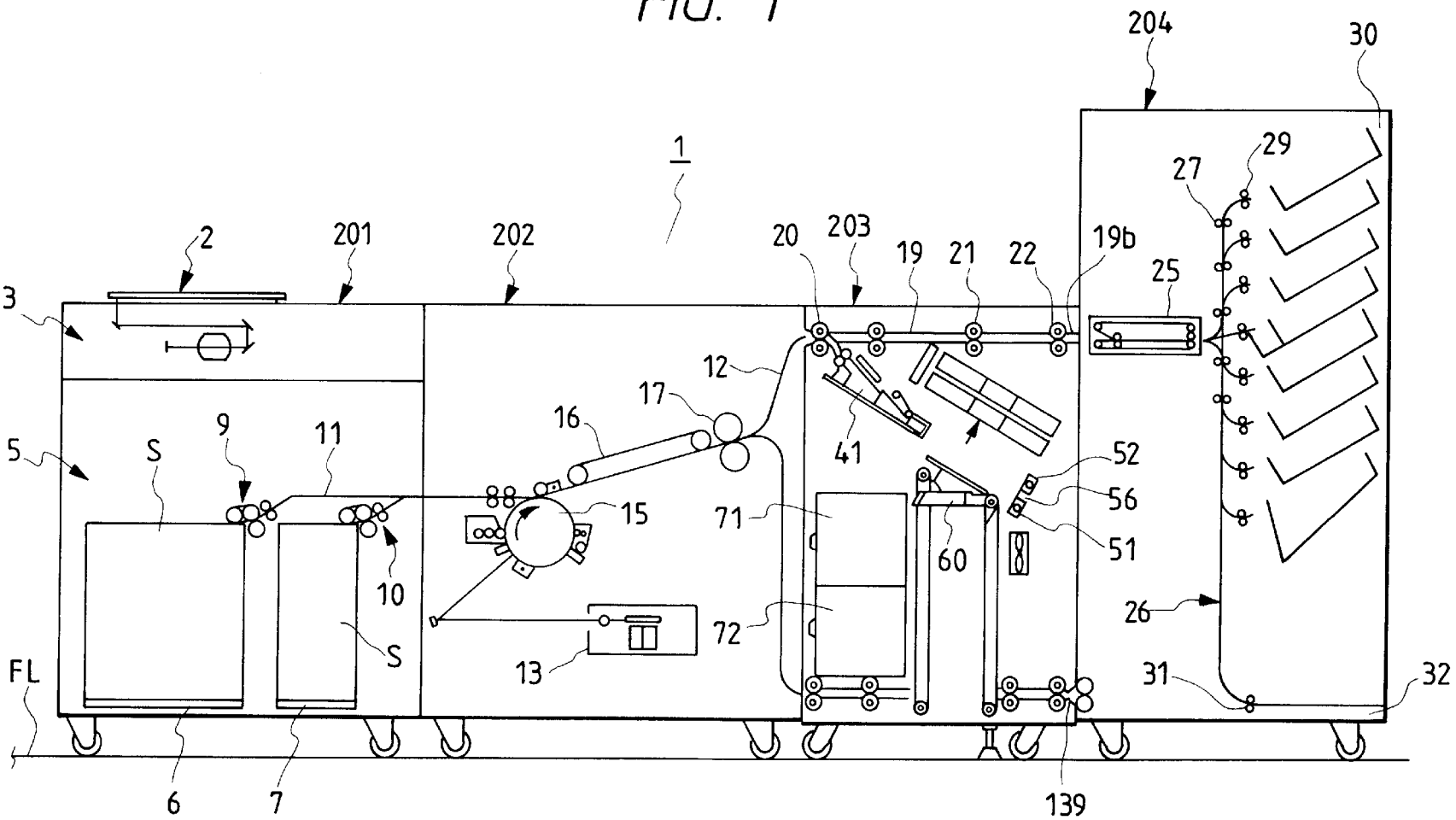
FIG. 1 is a longitudinal cross-sectional side view showing the general construction of an on-line apparatus to which the present invention is applied.

Referring to FIG. 1 which shows the general construction of an on-line apparatus to which the present invention is applied, the on-line apparatus 1 is constructed by a reading and paper supply apparatus 201, image forming apparatus 202, a bookbinding apparatus 203 and an assorting and containing apparatus 204 being continuously connected together.

The reading and paper supply apparatus 201 has in the upper portion thereof an original supporting table portion 2 on which an original is set, and an optical system 3 for reading and scanning the set original. In the lower portion thereof, there are disposed a plurality of paper supply decks 6 and 7 on which sheets S of different sizes are stacked, and paper supply portions 9 and 10 for supplying the sheets S.

The supplied sheets S are conveyed through a sheet conveying portion 11 to the sheet conveying path 12 of the image forming apparatus 202 downstream thereof. The reference numeral 13 designates a laser scanner emitting a laser beam based on image information read by the optical system 3, and the reference numeral 15 denotes an image forming portion (a photosensitive drum) on which a toner image is formed. The sheets S on which images have been formed by the image forming portion 15 are conveyed to the sheet conveying path 19 of the downstream bookbinding apparatus 203 by a conveying belt 16 and a pair of conveying rollers 17.

Figure 2:
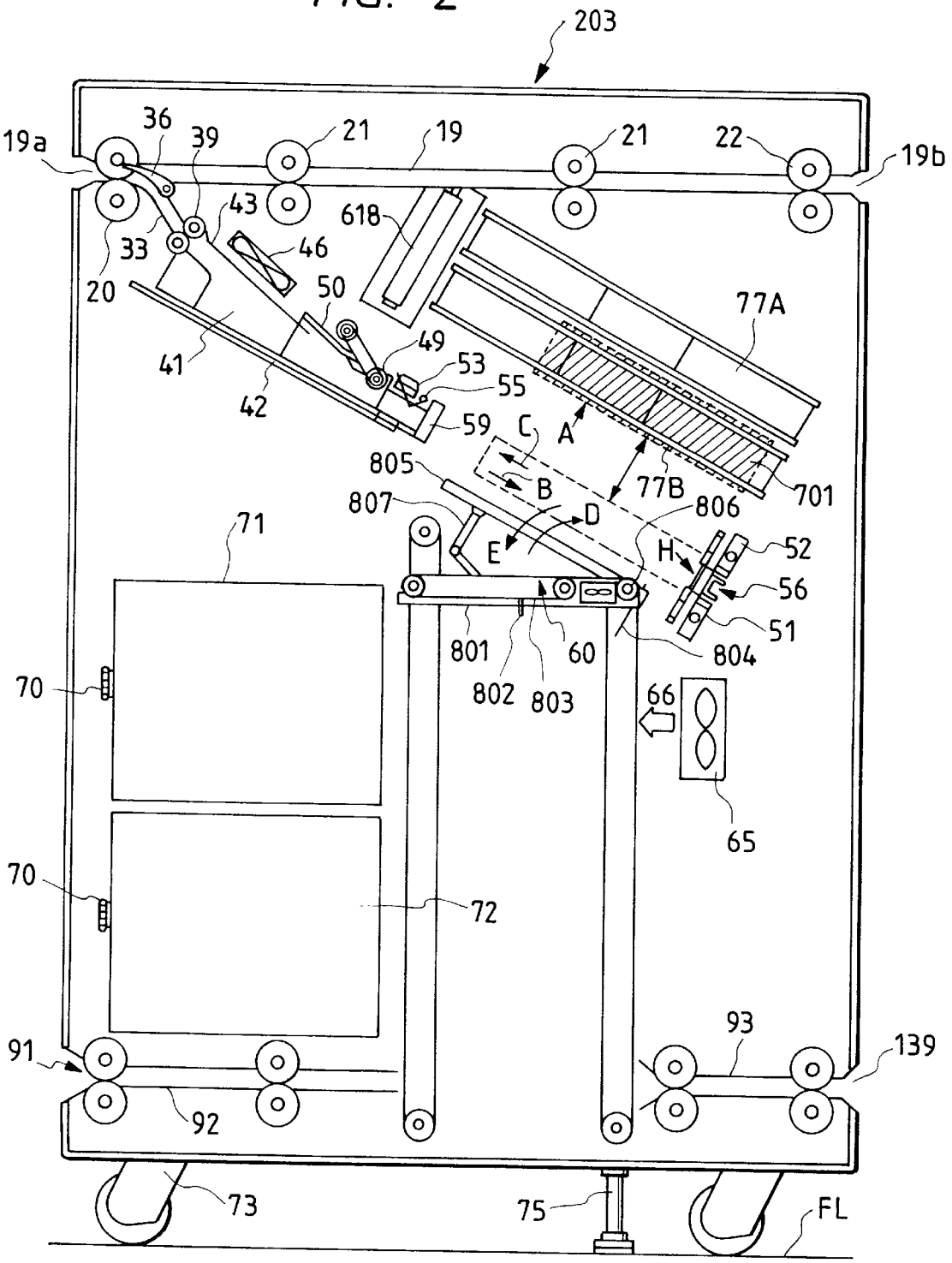
FIG. 2 is a longitudinal cross-sectional view showing the detailed construction of a bookbinding apparatus in the on-line apparatus of FIG. 1.

The bookbinding apparatus 203, as shown in FIG. 2, is provided with a sheet aligning tray 41 for receiving and aligning the sheets S conveyed while branching off from the sheet conveying path 19, a dashing member 59 against which the leading end of the sheet is dashed, a tape heating device 56 for heating an aligned bundle of sheets and a bind tape, a vertically movable carriage 60 provided with a handling member 805 for handling a completely bound article, and stackers 71 and 72 in which the completely bound article is contained.

In the sorting and containing apparatus 204, the reference numeral 25 in FIG. 1 designates an elevator for transmitting the sheets S conveyed along the sheet conveying path 19 to a conveying pass 26, the reference numeral 27 denotes pairs of conveying rollers disposed in the plurality of branch-off portions of the conveying pass 26, and the reference numeral 29 designates pairs of discharge rollers for discharging the sheets S having branched off in the respective branch-off portions onto corresponding discharge trays 30. Also, the completely bound article discharged from the discharge port 139 of the bookbinding apparatus 203 can be discharged out of the apparatus from a discharge port 32 through the elevator 25 and a pair of conveying rollers 31.

The bookbinding apparatus 203, when the assorting and containing apparatus 204 is not connected thereto, is provided with a stacking tray (not shown) on which sheets discharged to a first discharge port 19*b* are stacked, and a stacking tray (not shown) on which completely bound articles discharged to a second discharge port 139 are stacked.

FIG. 2 shows the detailed construction of the bookbinding apparatus 203.

The bookbinding apparatus 203 has a sheet conveying path 19 for the sheets S conveyed from the image forming apparatus 202 and a first carry-in port 19*a* and the first discharge port 19*b* are formed in the opposite end portions thereof. Along the sheet conveying path 19, there are disposed a pair of carry-in rollers 20, a plurality of pairs of conveying rollers 21 and a pair of discharge rollers 22 in succession from the upstream side.

A flapper 36 is disposed near the downstream side of the pair of carry-in rollers 20 and divides the sheet conveying path 19 to a guide portion 33. When the flapper 36 is operated to direct the sheets S to the guide portion 33 or is not operated, the sheets S are intactly conveyed in the conveying path 19.

On the downstream side of the guide portion 33, the sheet aligning tray 41 having an upper guide plate 43 is disposed so that the downstream side thereof may be low, and on the fore end side thereof, there is disposed the dashing member 59 against which the sheets S are dashed. The sheets S carried into the sheet aligning tray 41 by a pair of conveying rollers 39 are brought toward the dashing member 59 by a sweep-up member 49 comprising a belt having one end thereof pivotable with the left upper portion thereof as viewed in FIG. 2 as the center of pivotal movement, and are dashed and aligned.

Also, the alignment of the sheets in the widthwise direction thereof is effected by a sweep-up member 50 with the sheets brought toward the reference side. A fan 46 disposed on the upper portion of the upper guide plate 43 serves to hold down the sheets S carried in by the aligning tray 41 by air and prevent the bulging of the folded sheets S.

Figure 23:
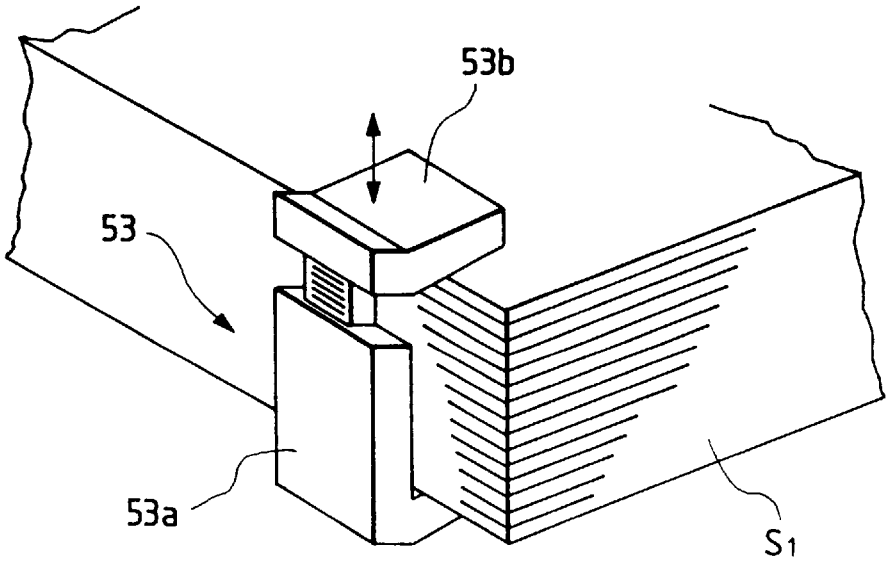
FIG. 23 is a perspective view showing the construction of a clamp member.

The reference numeral 53 designates a clamp member for holding a designated number of sheets S (a sheet bundle S1) aligned on the aligning tray 41. This clamp member 53 is used also as means for detecting (measuring) the thickness of the sheet bundle S1. As shown in FIG. 23, the clamp member 53 comprises a positionally fixed lower clamp member 53*a* and a vertically movable upper clamp member 53*b*. The upper clamp member 53*b* stands by at a height position (home position) which will not hinder the stacking and alignment of the sheet bundles S1, and is adapted to be downwardly moved and to hold the sheet bundles S1 between itself and the lower clamp member 53*a* with predetermined pressure when the stacking and alignment of the sheet bundles S1 onto the aligning tray 41 are terminated.

Figure 24:
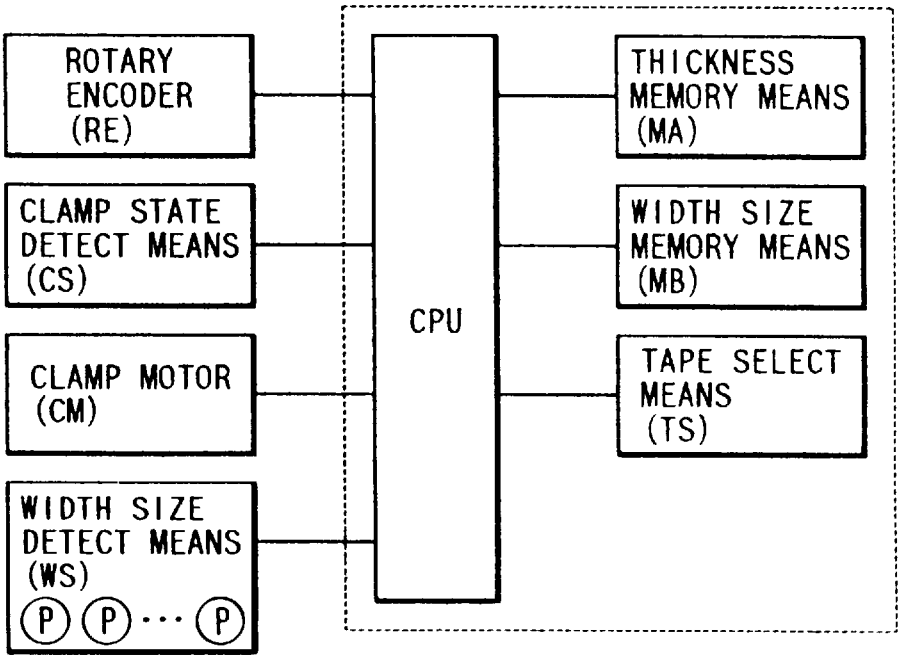
FIG. 24 is a block diagram of a control unit for controlling the clamping operation of the clamp member.

The upper clamp member 53*b* is adapted to be moved by a clamp motor CM shown in FIG. 24, and the clamp motor CM drives the clamp member 53*b* until clamp state detecting means CS detects a clamp state. In this case, the drive distance of the clamp motor CM is detected by a rotary encoder RE mounted on the output shaft of the clamp motor CM, and a CPU for controlling the operation of the entire on-line apparatus 1 calculates the thickness of the sheet bundle S1 from the drive distance of the clamp motor CM detected by the rotary encoder RE. As the clamp state detecting means CS, use is made, for example, of a pressure detecting sensor adapted to bear against the sheet bundle S1 and output an ON signal when it detects predetermined pressure, or a microswitch or the like adapted to become ON when it bears against the sheet bundle S1.

Figure 25:
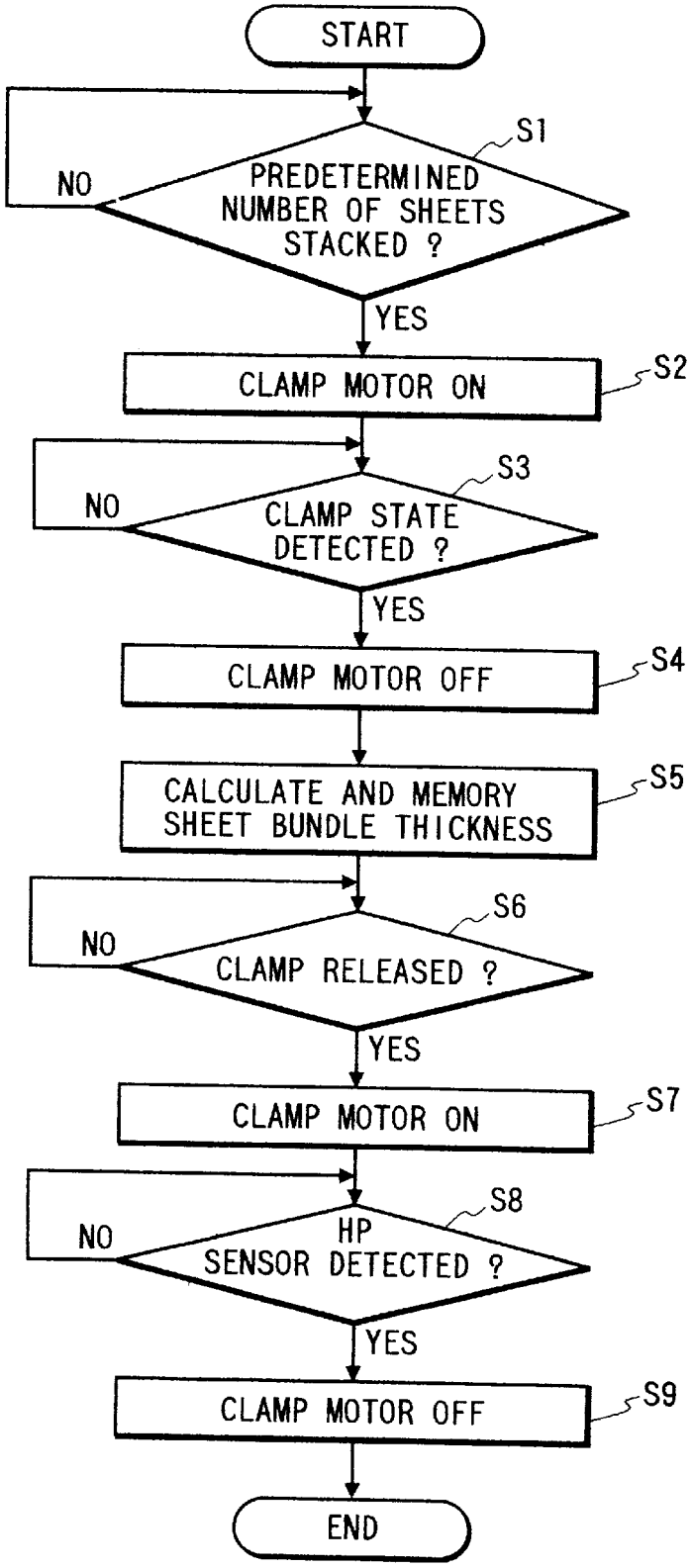
FIG. 25 is a flow chart showing an example of the operation of a CPU when the bundle of sheets is clamped by the clamp member.

FIG. 25 shows an example of the operation of the CPU when the sheet bundle S1 is clamped by the clamp member 53. First, whether a predetermined number of sheets S have been stacked on the aligning tray 41 is checked up (S1), and if the predetermined number of sheets S have been stacked, the clamp motor CM is switched on and is driven in a direction to hold the sheet bundle S1(S2). Thereby, the upper clamp member 53*b* having so far stood by at the home position is lowered.

Subsequently, whether a detection signal has been sent from the clamp state detecting means CS is checked up (S3), and if the detection signal has been sent, the clamp motor CM is switched off (S4). Thereby, the sheet bundle S1 is held between the lower clamp member 53*a* and the upper clamp member 53*b* with predetermined pressure. Subsequently, the thickness of the sheet bundle S1 is calculated from the drive distance of the clamp motor CM detected by the rotary encoder RE and is memorized by thickness memory means MA (S5). The CPU chooses a thickness corresponding to the drive distance detected by the rotary encoder RE, from among data representative of the relation between a drive distance and a thickness memorized in advance, and causes it to be memorized in the thickness memory means MA.

Subsequently, whether a clamp releasing signal has been inputted is checked (S6), and if the clamp releasing signal has been inputted, the clamp motor CM is switched on and is driven in a direction to release the clamping of the sheet bundle S1(S7). Subsequently, whether a home position sensor has detected the upper clamp member 53*b* is checked (S8), and if a detection signal has been inputted from the home position sensor, the clamp motor CM is switched off (S9).

Turning back to FIG. 2, the reference numeral 42 designates an auxiliary guide plate for sheet bundles, and the reference numeral 55 denotes a stop finger (adapted to operate when a sheet bundle corresponding to one volume is contained, and temporarily store the lead several sheets of the next sheet bundle).

A carriage 60 for transferring a completely bound sheet bundle S1 has the following constituent members. In FIG. 2, the carriage 60 has a housing 801 vertically movably supported by a rotatable chain or the like, a conveying belt 803 provided in this housing 801 for forward and reverse rotation, a trailing end pushing member 802 movable following this conveying belt 803, a sheet bundle trailing end supporting plate 804 for supporting the sheet bundle by the trailing end of the sheet bundle conveyed by the auxiliary guide plate 42 striking against it and pivotally movable about a support shaft 806 from the position of the end portion of the sheet bundle to a retractable position, a sheet bundle supporting bar 805 supported by a link 807 expanding and contracting between a position for receiving the bound bundle sheet and a position for delivering it to the belt 803, etc. The supporting bar 805 is pivotally movable about the support shaft 806.

After the clamp member 53 has spaced the sheet bundle S1 apart from a tape heating device 56, the sheet bundle trailing end supporting plate 804 moves to a position for supporting the end portion of the sheet bundle, and the clamp member 53 is spaced apart from the sheet bundle S1, whereby the end portion of the sheet bundle is dashed against it and the sheet bundle S1 is supported.

The bookbinding apparatus 203 is provided with a first tape reel 77A on which a bind tape T1 of a great width is taken up and a second tape reel 77B on which a bind tape T2 of a small width is taken up, so as to be capable of coping with thick sheet bundles and thin sheet bundles. The bind tape T1 of a great width taken up on the first tape reel 77A is used for thick sheet bundles, and the bind tape T2 of a small width taken up on the second tape reel 77B is used for thin sheet bundles.

The width size information of the tapes T1 and T2 taken up on the tape reels 77A and 77B is read by width size detecting means WS shown in FIG. 24 and sent to the CPU when the tape reels are set. The CPU causes the width sizes sent thereto to be memorized by width size memory means MB, and tape selecting means TS automatically select a bind tape conforming to the thickness of the sheet bundle S1 from among the width sizes memorized by the width size memory means MB and supplies it to a bookbinding portion. The operation of the tape selecting means TS automatically selecting a bind tape to be sent to the bookbinding portion from among a plurality of kinds of tape width sizes will be described later.

Figure 26A:
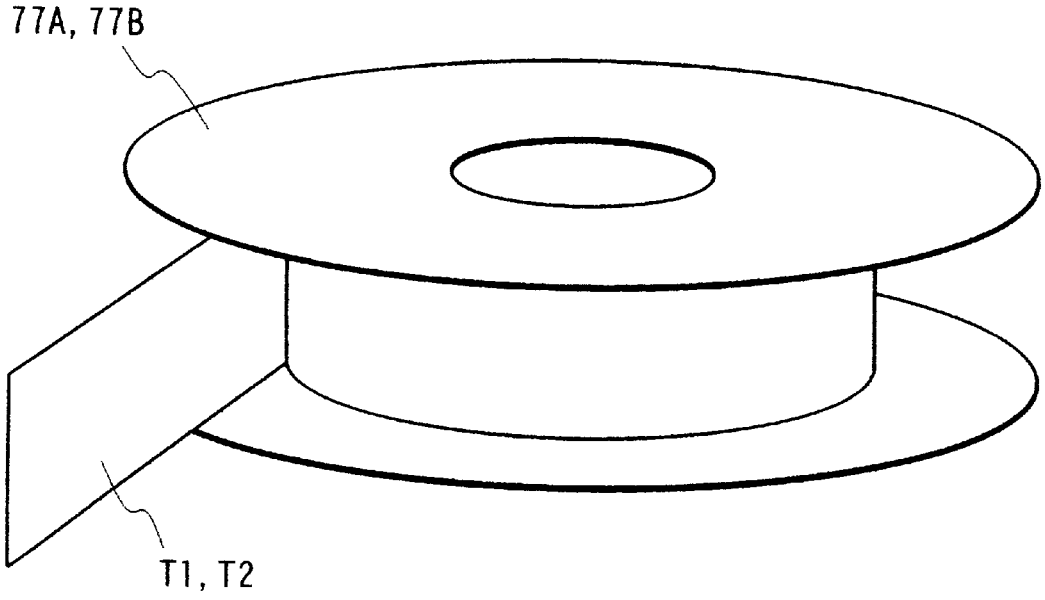
FIGS. 26A and 26B are perspective views showing the construction of a tape reel.
Figure 26B:
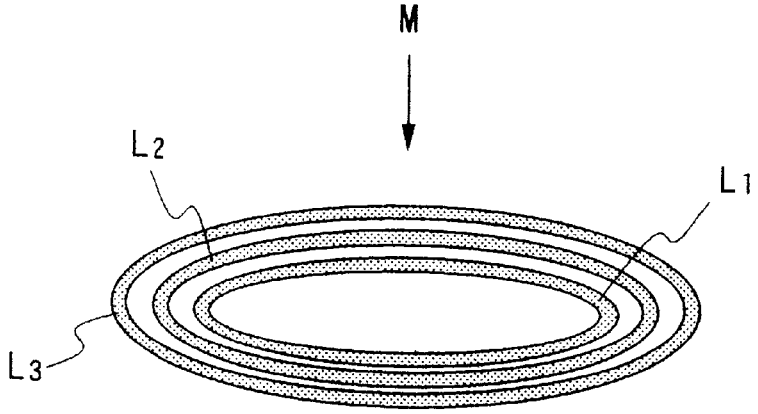

FIG. 26A shows the construction of the tape reel 77A, 77B. In the case of the present embodiment, a width size discrimination mark M shown in FIG. 26B is attached to the central portion of the tape reel 77A, 77B. For example, in the case of the tape reel 77A on which the bind tape T1 of a great width size is taken up, three rings L1, L2 and L3 are formed, and in the case of the tape reel 77B on which the bind tape T2 of a small width size is taken up, two rings L1 and L2 are formed.

At locations in the bookbinding apparatus 203 whereat the tape reels 77A and 77B are installed, there are installed a plurality of photosensors P (width size detecting means) for detecting the rings L1 to L3, and when the tape reels 77A and 77B are set, they detect the rings L1 to L3. For example, in the case of the tape reel 77A, L1 ="LOW", L2 ="LOW" and L3 ="LOW", and the CPU judges the width size to be great. Also, in the case of the tape reel 77B, L1 ="LOW", L2 ="LOW" and L3 ="HIGH", and the CPU judges the width size to be small.

The photosensors P, which may be of the reflection type or of the transmission type, can detect the rings L1 to L3.

The operation of supplying the bind tapes T1 and T2 from the tape reels 77A and 77B to the bookbinding portion will now be described with reference to FIGS. 3A to 5.

Figure 4:
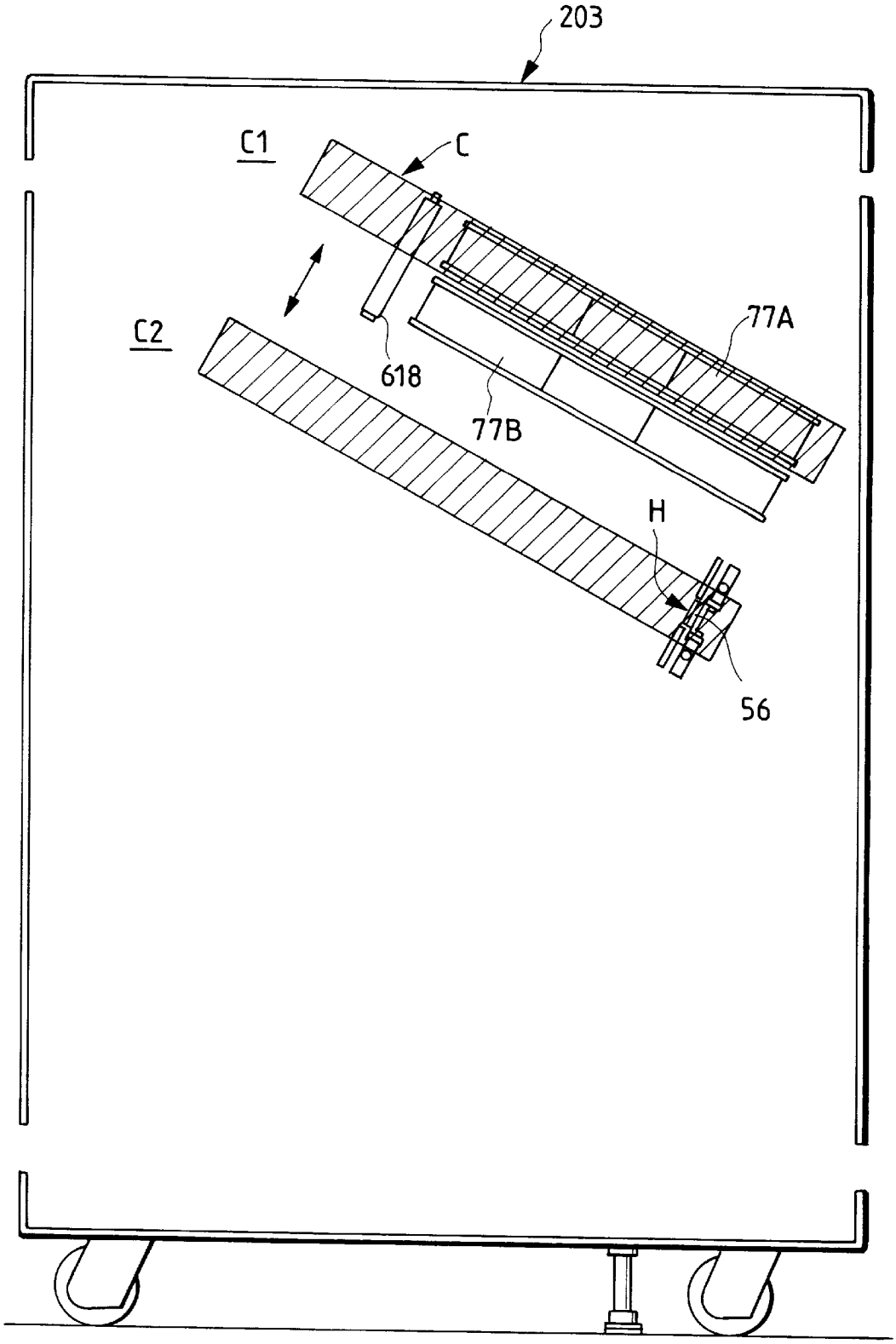
FIG. 4 is a longitudinal cross-sectional side view illustrating the operation of a carriage for transferring the bind tape.

As shown in FIG. 4, a carriage C for transferring the bind tape T1(T2) is movable in the directions of arrows between a tape receiving position C1 for receiving the bind tape T1(T2) from the tape reel 77A(77B) and a tape supplying position C2 for supplying the bind tape T1(T2) to a back bearing position H ahead of the tape heating device 56.

Figure 3A:
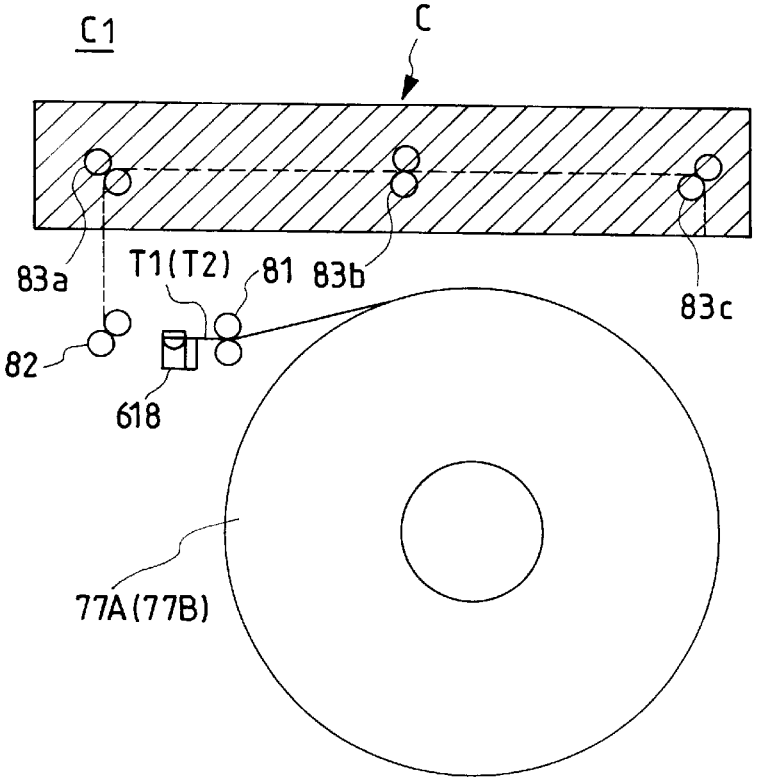
FIGS. 3A and 3B are plan views illustrating the operation of a device for supplying a bind tape.
Figure 3B:
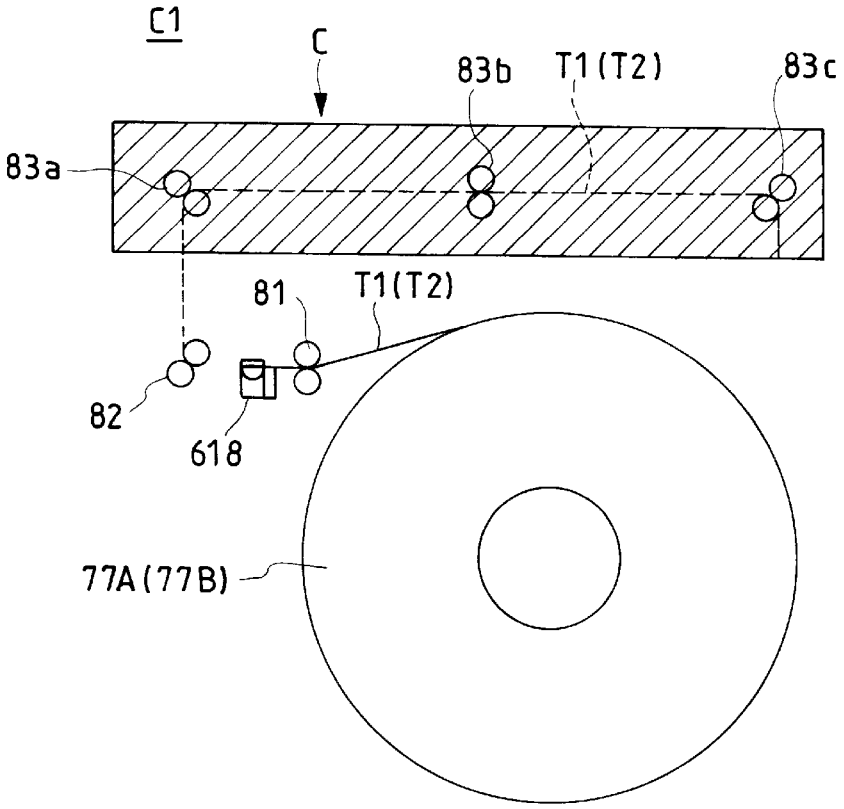

As shown in FIG. 3A, the leading end portion of the bind tape T1(T2) taken up on the tape reel 77A(77B) is drawn out by a pair of conveying rollers 81 and is at a position just in front of a cutter 618. During use, the bind tape is further drawn out and is cut into a predetermined length L by the cutter 618. The thus cut strip-like bind tape T1(T2), is supplied to the carriage C which is in the position C1 by a pair of conveying rollers 82, and is held by pairs of conveying rollers 83*a*, 83*b* and 83*c* in the carriage C, as shown in FIG. 3B.

Figure 5A:
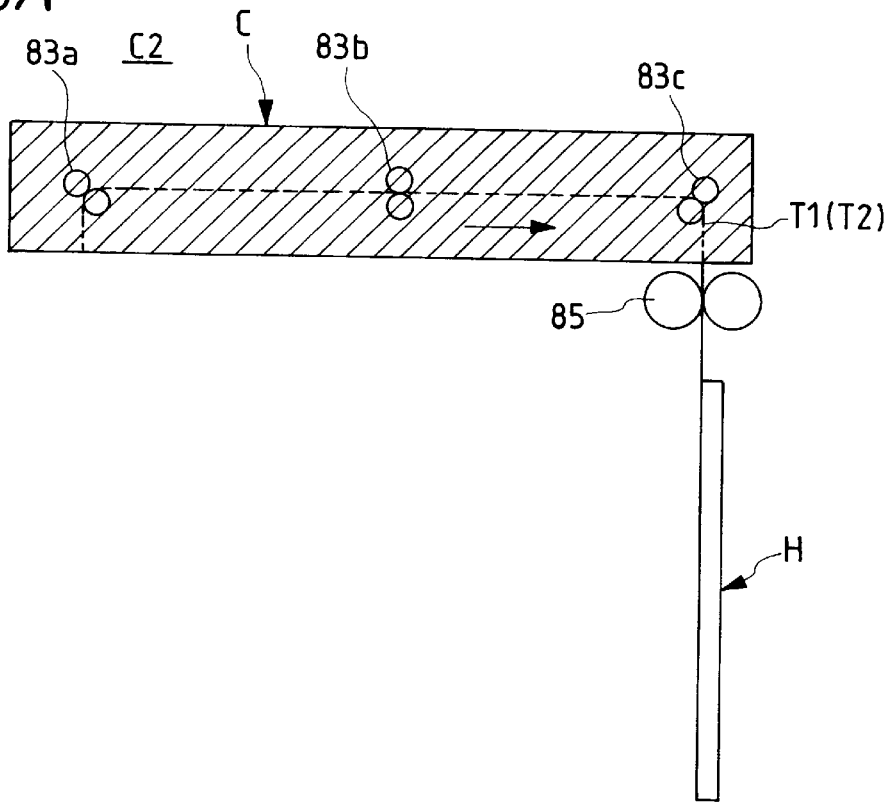
FIGS. 5A and 5B are plan views illustrating the operation of the carriage setting the bind tape at a back bearing position (a bookbinding portion).
Figure 5B:
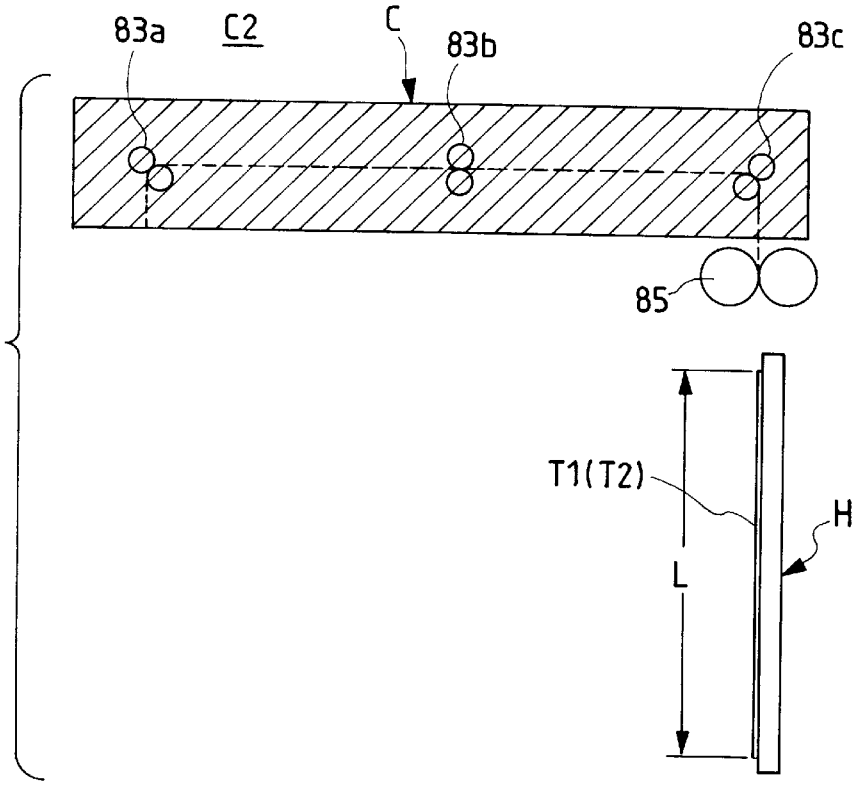

The carriage C holding the band tape T1(T2), as shown in FIG. 4, is moved from the position C1 to the position C2, whereafter as shown in FIG. 5A, the bind tape T1(T2) is drawn out in the direction of the arrow by the rotation of the pairs of conveying rollers 83*a* to 83*c*. The thus drawn-out bind tape T1(T2) is sent to the back bearing position H by a pair of conveying rollers 85. FIG. 5B shows a state in which the bind tape T1(T2) drawn out of the carriage C has been set at the back bearing position H.

In FIG. 2, the reference numeral 65 designates a fan for cooling a completely bound article. This fan 65 flows air in the direction of arrow 66. The reference numerals 71 and 72 denote stackers in which completely bound articles conveyed by a carriage 60 are contained, and the reference numeral 70 denotes a guide rail for slidably guiding the stackers 71 and 72.

FIGS. 6 to 9 show the carrying of the sheets S into the sheet aligning tray 41 and the transferred state of the aligned sheet bundle S1 to the back bearing position H.

Figure 6:
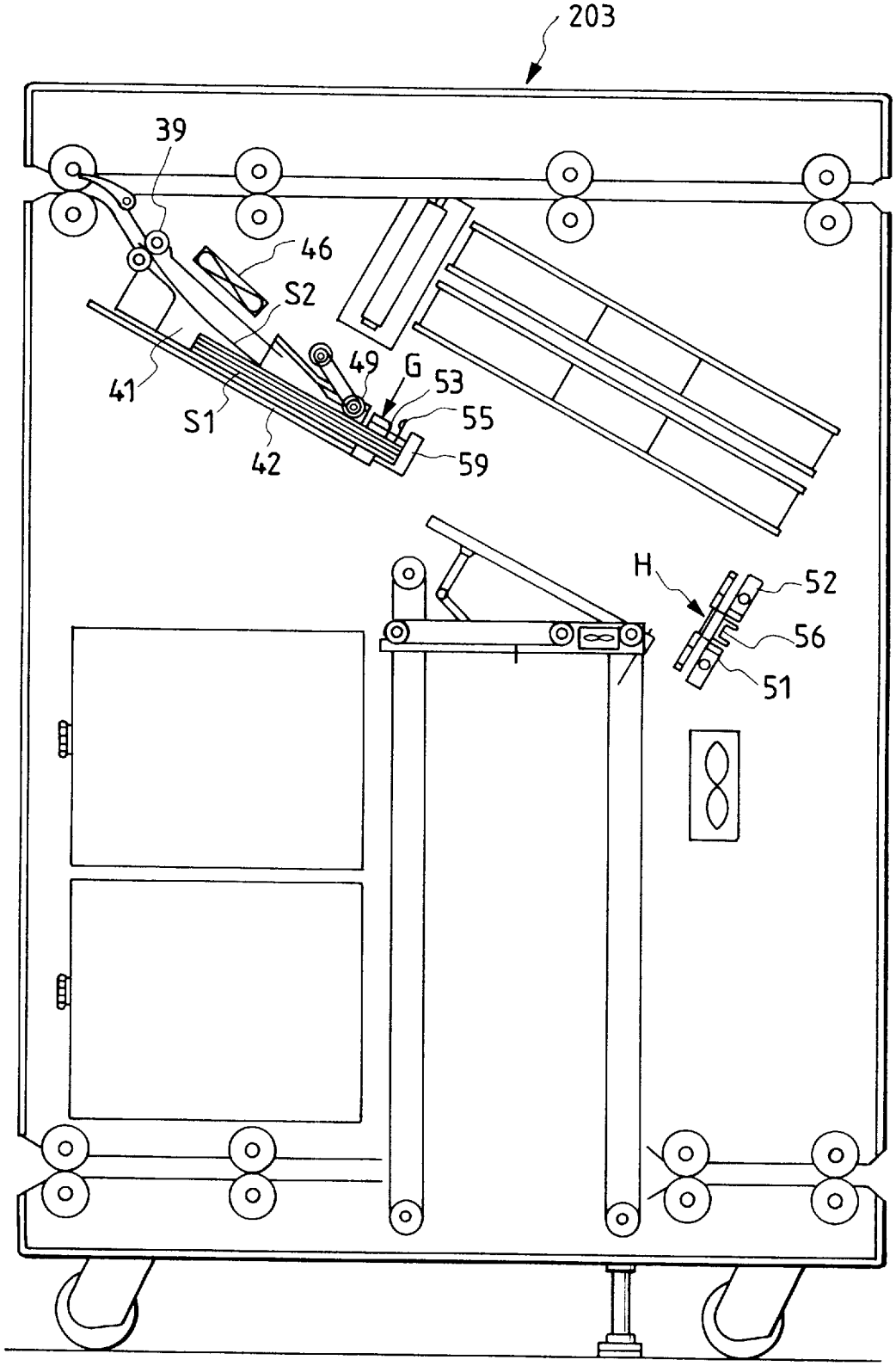
FIG. 6 is a longitudinal cross-sectional side view illustrating the operation of aligning sheets on the aligning tray of the bookbinding apparatus.

In FIG. 6, when sheets S to be bound (the sheet bundle S1) corresponding to one volume are carried into and aligned by the sheet aligning tray 41, the clamp member 53 is operated in the direction of arrow G, whereby the sheet bundle S1 is clamped. When the bookbinding of a plurality of volumes is to be effected, the stop finger 55 is operated at the same time and the lead several sheets S of the next bundle begin to be temporarily stored until the alignment is completed and the sheet bundle S1 clamped by the clamp member 53 is carried out of the aligning tray 41.

Figure 7:
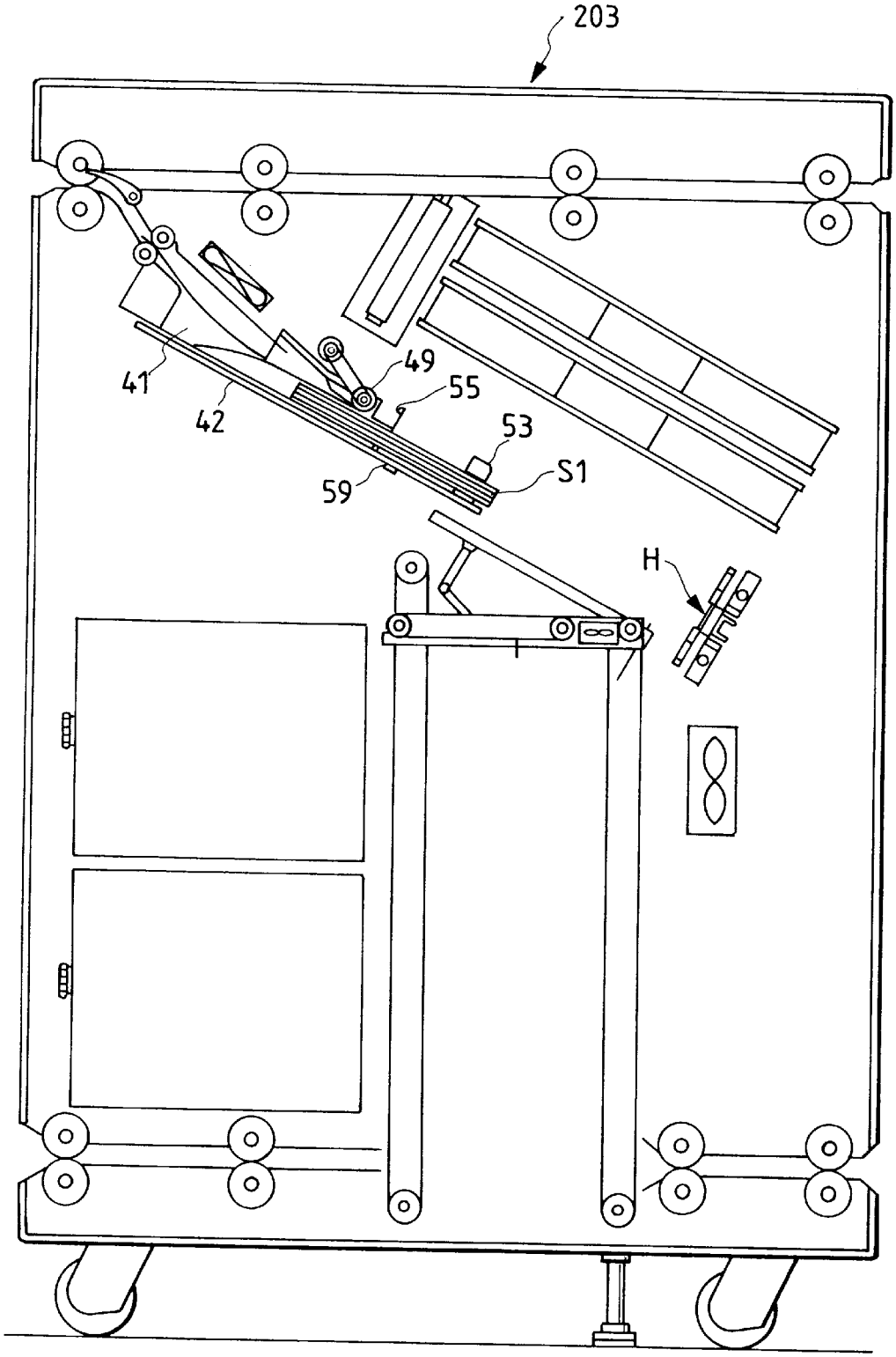
FIG. 7 is a longitudinal cross-sectional side view illustrating the operation of moving the bundle of sheets aligned on the aligning tray to the back bearing position.

FIG. 7 shows a state in which the dashing member 59 is retracted to a retracted position and the clamp member 53 moves the sheet bundle S1 from within the aligning tray 41 to the back bearing position H. The clamp member 53 clamps the sheet bundle S1 and moves straight toward the back bearing position H (in such a manner as not to apply unreasonable stress to the sheet bundle S1). At this time, substantially in operative association with the movement of the clamp member 53, the auxiliary guide plate 42 moves from the lower portion of the aligning tray 41 to the vicinity of the back bearing position H parallel with to and at a speed substantially equal to the sheet bundle S1, and guides the lower surface of the sheet bundle S1.

Figure 8:
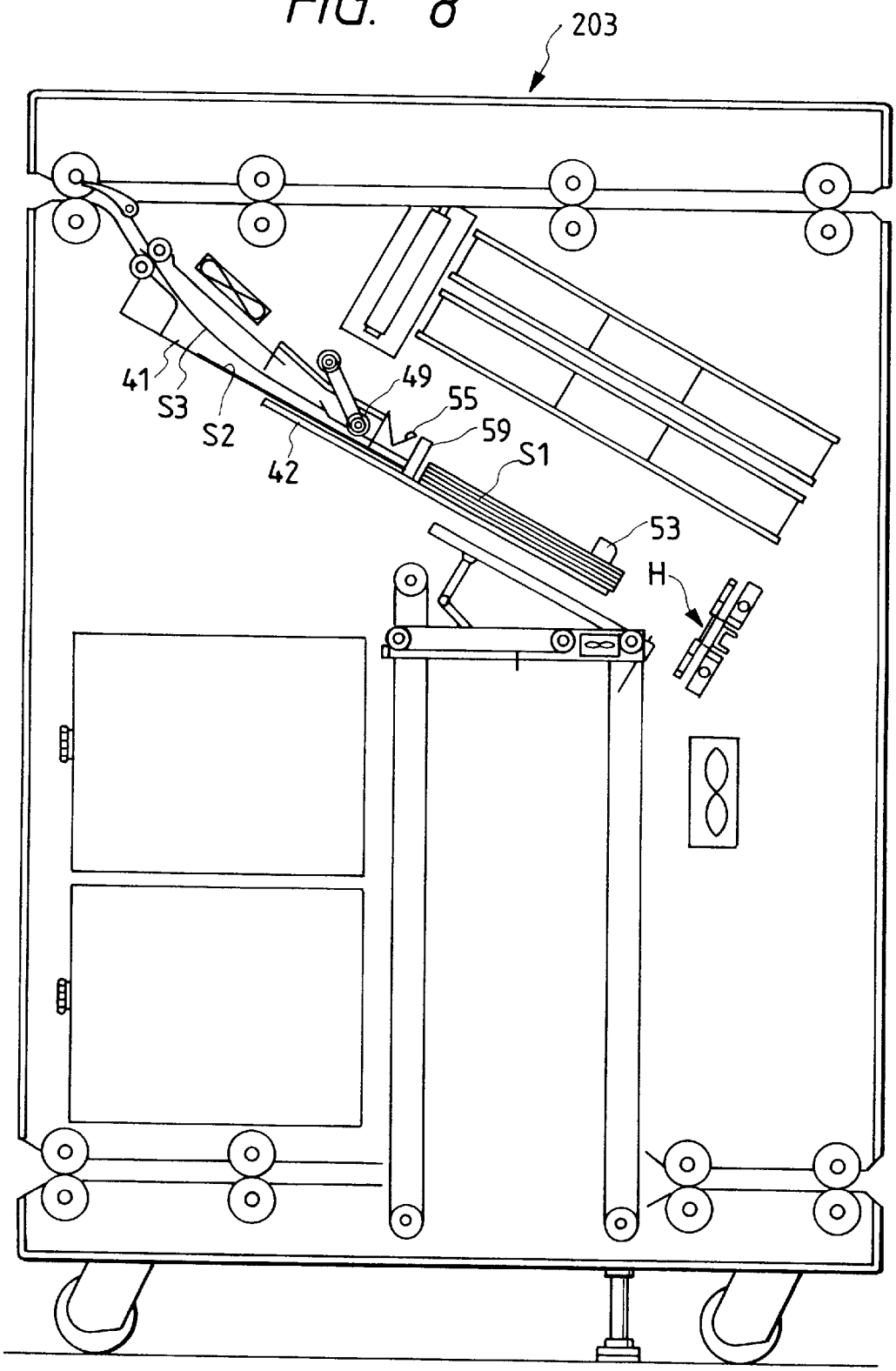
FIG. 8 is a longitudinal cross-sectional side view illustrating the operation of moving the bundle of sheets aligned on the aligning tray to the back bearing position.

FIG. 8 shows a state in which the sheet bundle S1 has been carried out of the aligning tray 41 by the clamp member 53. When the sheet bundle S1 is carried out of the aligning tray 41 by the clamp member 53, the dashing member 59 returns to the dashing portion, and the stop finger 55 retracts from a storing position to a retracted position and positions the stored number of sheets S2 in the aligning tray 41 and aligns the sheets S3 carried into the aligning tray 41.

Figure 9:
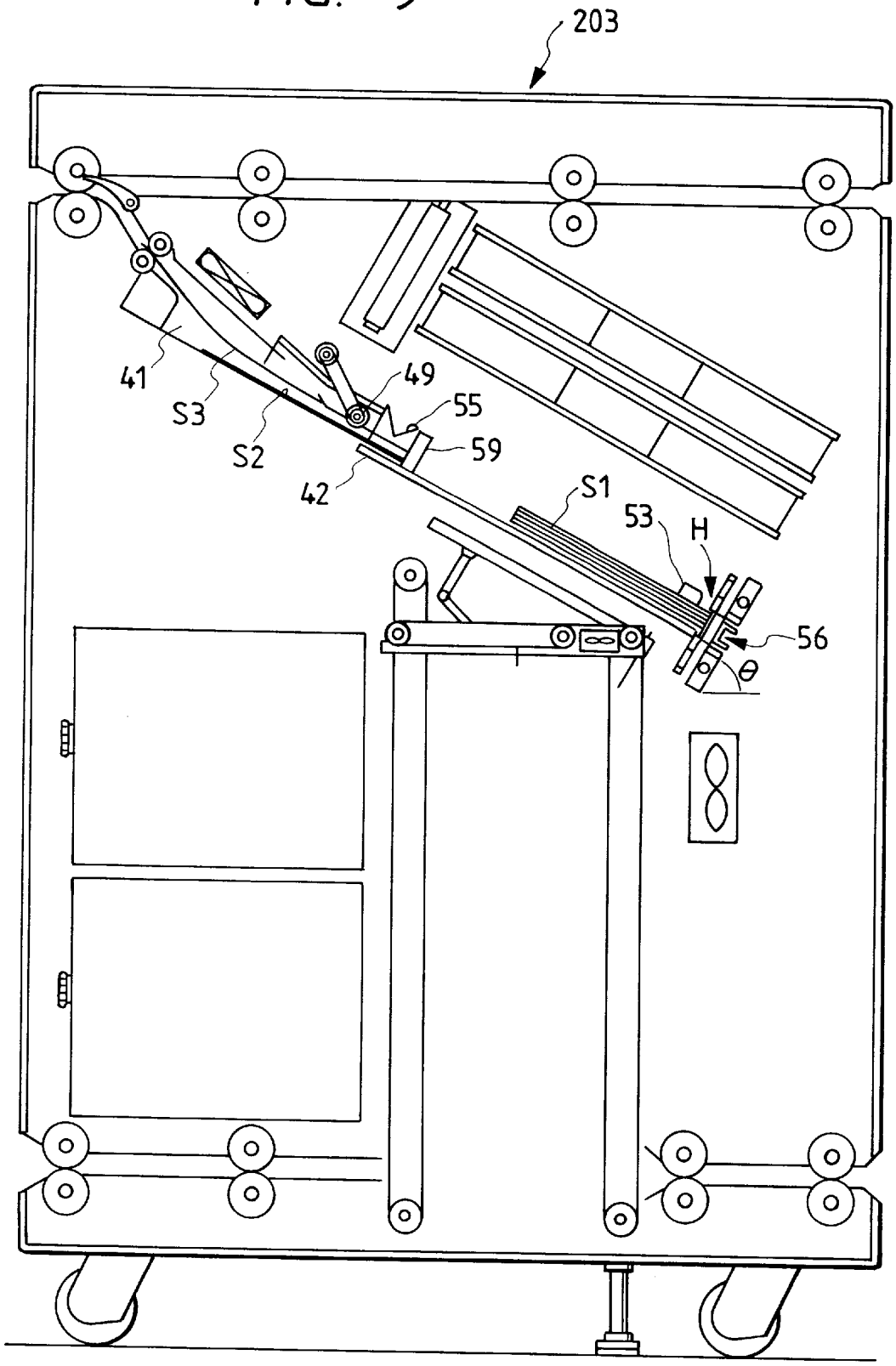
FIG. 9 is a longitudinal cross-sectional side view illustrating the operation of moving the bundle of sheets aligned on the aligning tray to the back bearing position.

FIG. 9 shows a state in which the sheet bundle S1 is set at the back bearing position H by the clamp member 53. The sheet bundle S1 is clamped by the clamp member 53 and is moved straight (without unreasonable stress being applied thereto) with the lower surface thereof being guided by the auxiliary guide plate 42 and is set at the back bearing position H.

The distance between the dashing member 59 and the heater 56 (H) is longer than the size of the sheet bundle S1 to be bound.

Figure 10A:
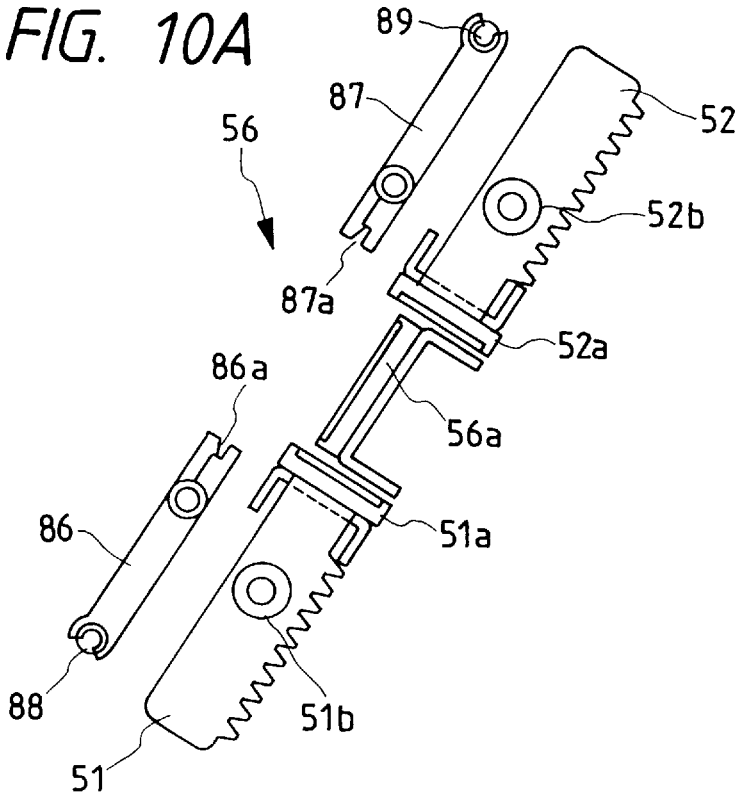
FIG. 10A is a longitudinal cross-sectional side view showing the construction of the tape heating device of the bookbinding apparatus.

FIG. 10A shows the construction of the tape heating device 56.

The tape heating device 56 has a back heater 56*a* for heating the strip-like bind tape T1(or T2) out from the taken-up bind tape T1(or T2). S1de heaters 51 and 52 disposed on both sides of the back heater 56*a* have heaters 51*a* and 52*a* inside thereof and rollers 51*b* and 52*b* on the sides thereof. Take guides 86 and 87 having guide portions 86*a* and 87*a* at the inner ends thereof are disposed near the side heaters 51 and 52, respectively. These tape guides 86 and 87 are pivotally movable about support shafts 88 and 89, respectively.

Figure 10B:
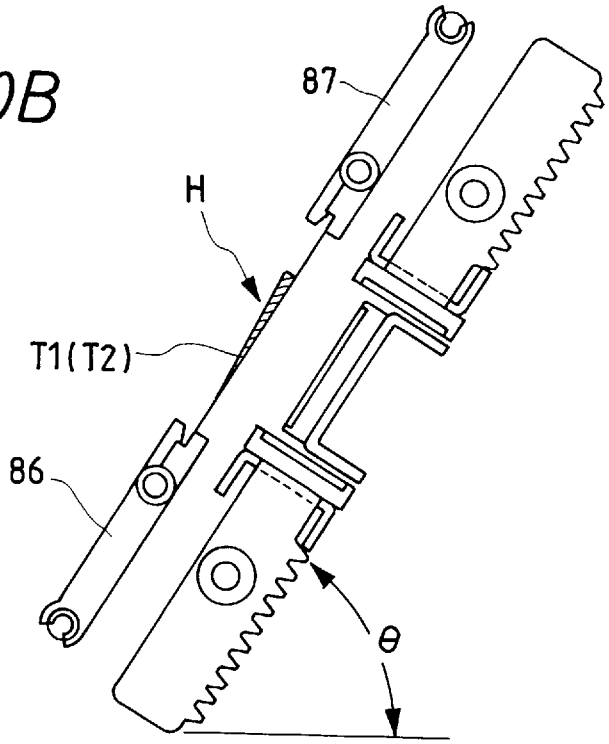
FIG. 10B is a longitudinal cross-sectional side view showing a state in which the bind tape has been set on the tape heating device.

FIGS. 10B to 15 show the operative state of the tape heating device 56. FIG. 10B shows a state in which the bind tape T1(or T2) has been guided to tape guides 86 and 87 by a bind tape supplying device and has been supplied to and set at the back bearing position H. When the bind tape T1(or T2) is set at the back bearing position H, the back heater 56*a* is moved in the direction of the arrow as shown in FIG. 11A and starts the preheating of the bind tape T1(or T2).

Figure 11A:
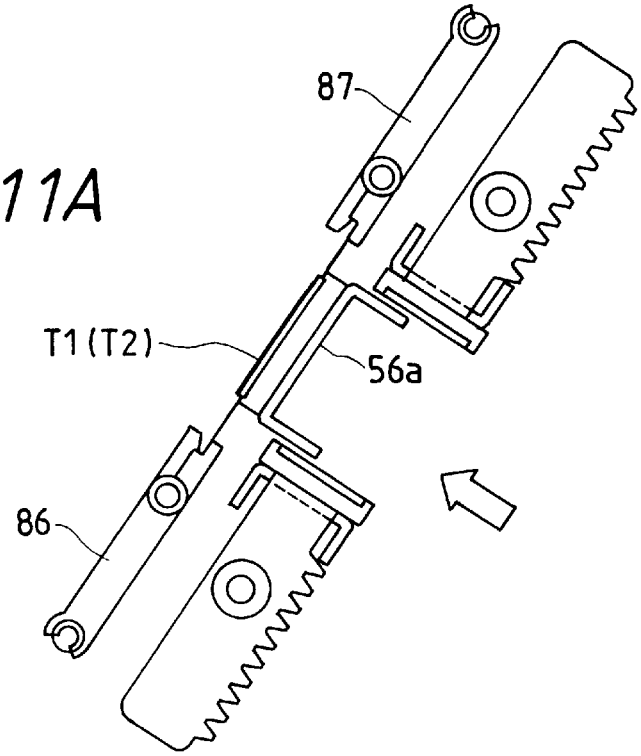
FIG. 11A is a longitudinal cross-sectional side view showing a state in which the back heater of the tape heating device has been moved to the back of the bind tape and has started heating.
Figure 11B:
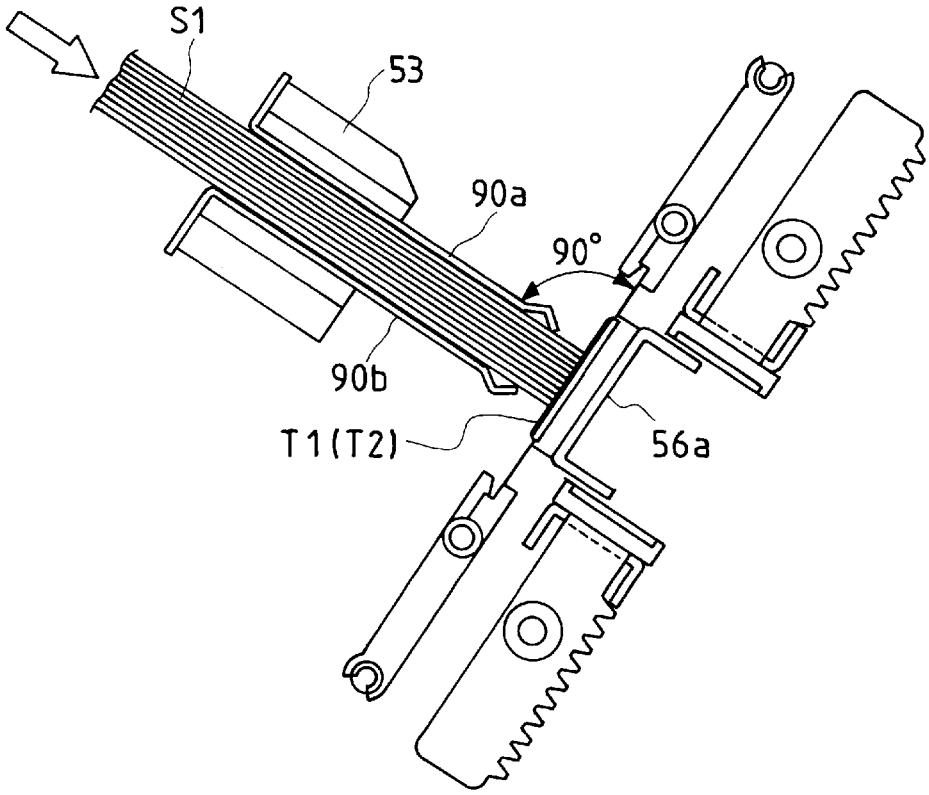
FIG. 11B is a longitudinal cross-sectional side view showing a state in which the bundle of sheets has been pushed against the heated bind tape.

FIG. 11B shows a state in which the aligned sheet bundle S1 is transferred from the aligning tray 41 to the back bearing position H by the clamp member 53 and the back of the sheet bundle S1 bears against the adhesive surface of the bind tape T1(or T2). At this time, near the back side end portion of the sheet bundle S1, upper and lower regulating guides 90*a* and 90*b* guide the sheet bundle S1. This is for preventing the sheets S from being widened by the curl or gravity of the sheets S or by the heat of the heating means.

Figure 12A:
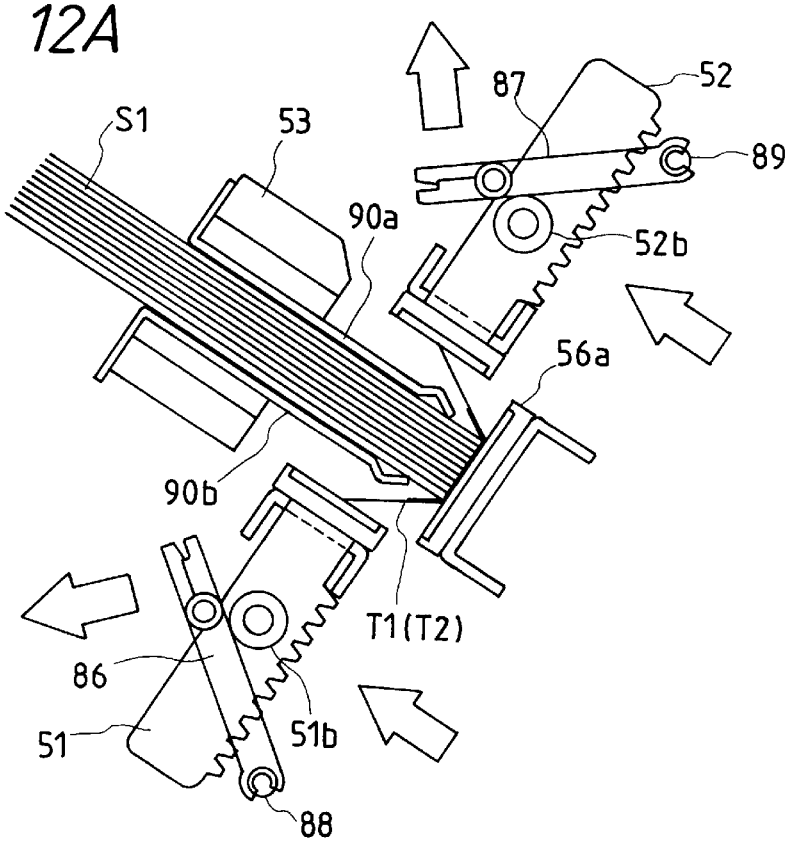
FIGS. 12A and 12B are longitudinal cross-sectional side views illustrating the operation of the side heater of the tape heating device effecting the binding of a side of the bundle of sheets.

When the back binding of the sheet bundle S1 is completed, as shown in FIG. 12A, the side heaters 51 and 52 retract the tape guides 86 and 87 and start the binding of the side of the sheet bundle while raising the end portion of the bind tape T1(or T2). At this time, the upper and lower regulating guides 86 and 87 are retracted from the leading end of the sheets with the movement of the side heaters 51 and 52.

Figure 12B:
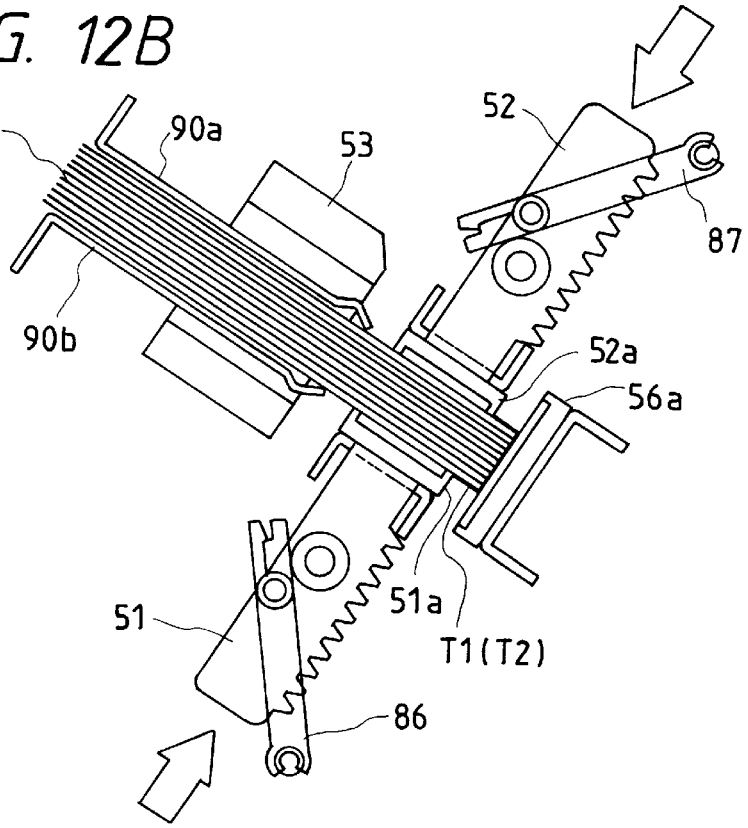
Figure 13A:
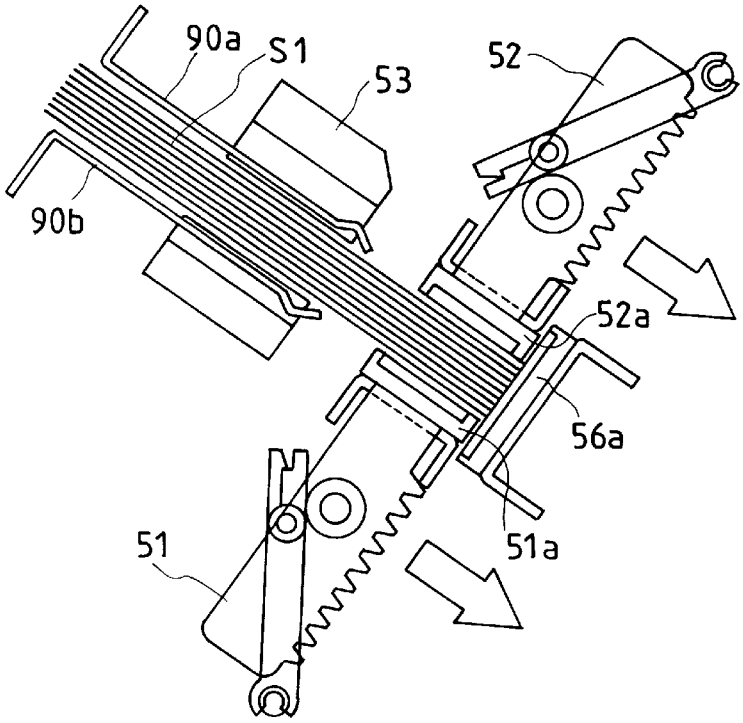
FIGS. 13A and 13B are longitudinal cross-sectional side views illustrating the operation of the side heater of the tape heating device effecting the binding of the side of the bundle of sheets.

FIG. 12B shows a state in which the binding of the side of the sheet bundle S1 is being done. The side heaters 51 and 52, as shown, are moved in the directions of arrows and press the both sides of the leading end of the sheet bundle S1 with the bind tape T1(or T2) interposed therebetween and effect the binding of the side of the sheet bundle (at this time, as described, the tape guides 86, 87 and the upper and lower regulating guides 90*a* and 90*b* have been retracted to their shown positions). In order to effect the finishing of the bent portion of the bind tape T1(or T2), the side heaters 51 and 52 apply a squeeze in the direction of the arrow while pressing the side of the sheet bundle 51, as shown in FIG. 13A.

Figure 13B:
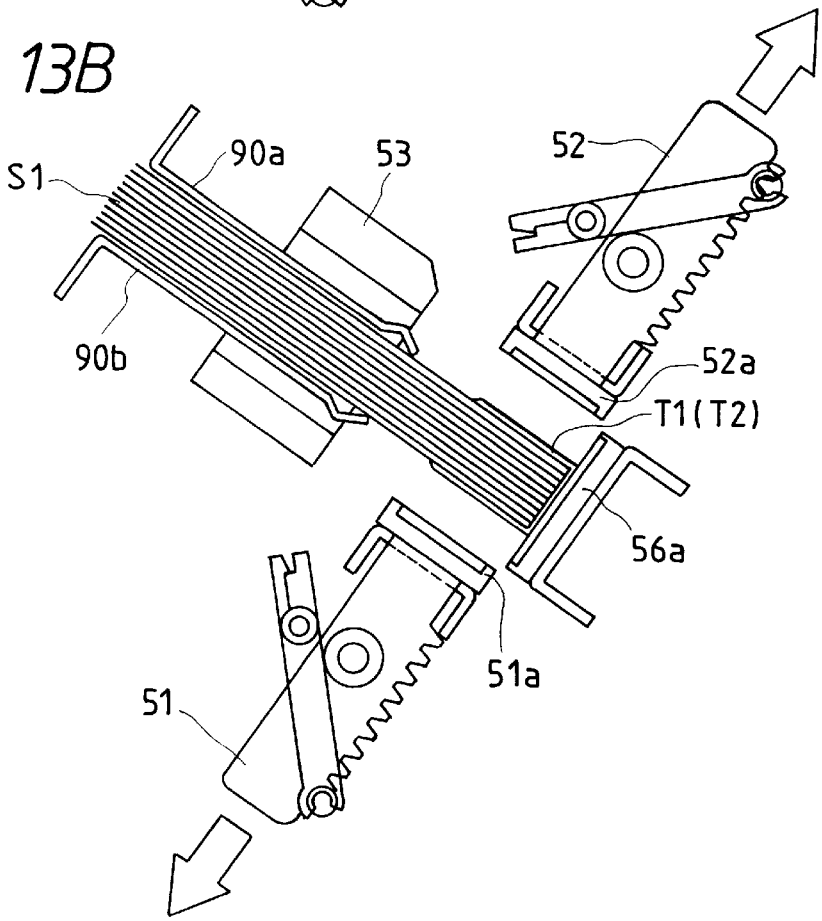
Figure 14A:
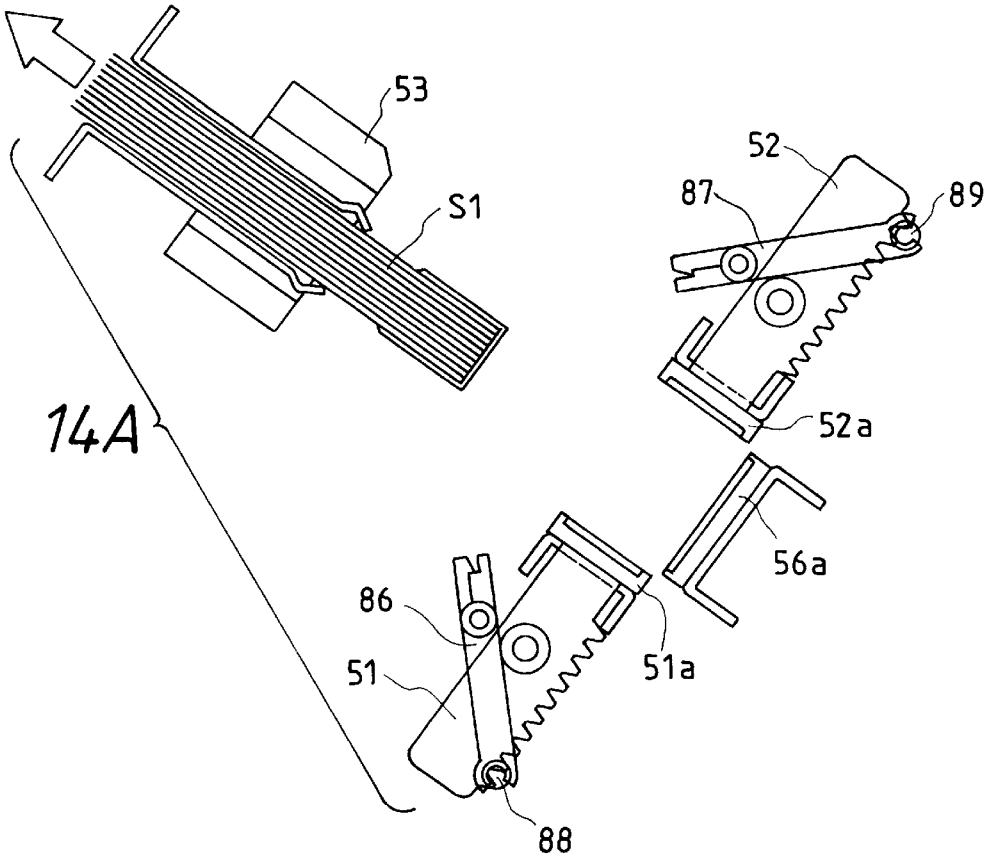
FIGS. 14A and 14B are longitudinal cross-sectional side views illustrating the operation of the tape heating device after the bookbinding has been completed and the retracting movement of the bundle of sheets.

Subsequently, as shown in FIG. 13B, the side heaters 51 and 52 are moved in the directions of the arrows and the pressing by the side heaters 51 and 52 is released. Thereupon, as shown in FIG. 14A, the clamp member 53 retracts the completely bound article S1 from the back bearing position H and transfers the completely bound article S1 to the delivery position (see FIG. 16) to the carriage 60.

Figure 14B:
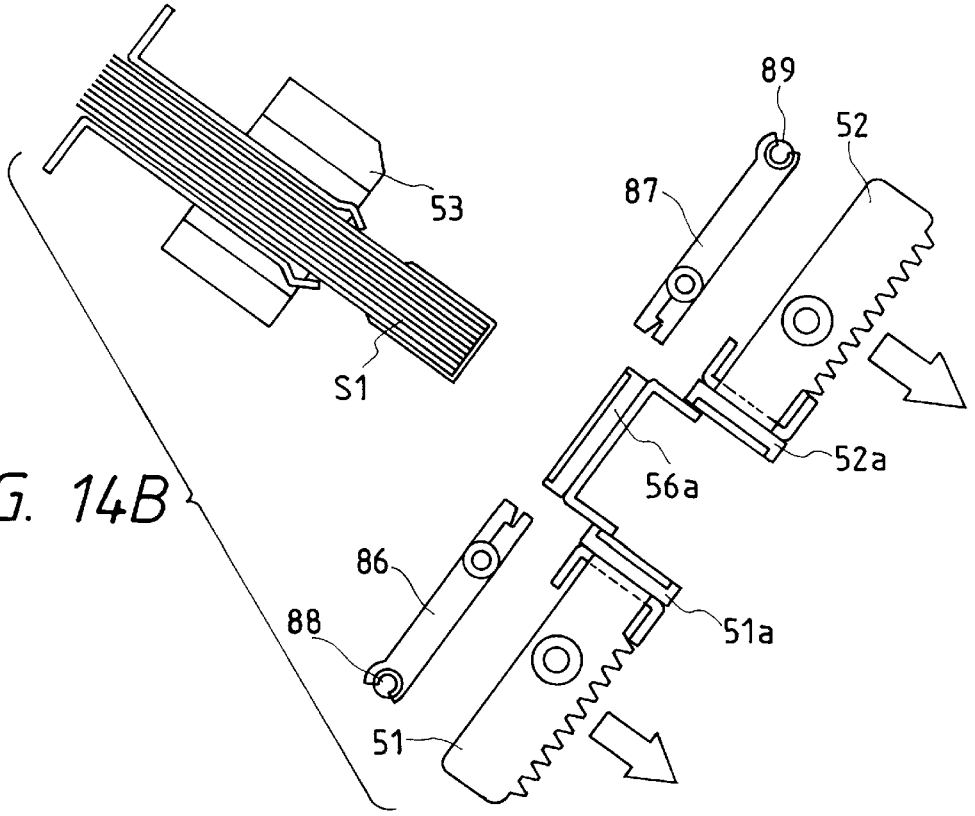
Figure 15:
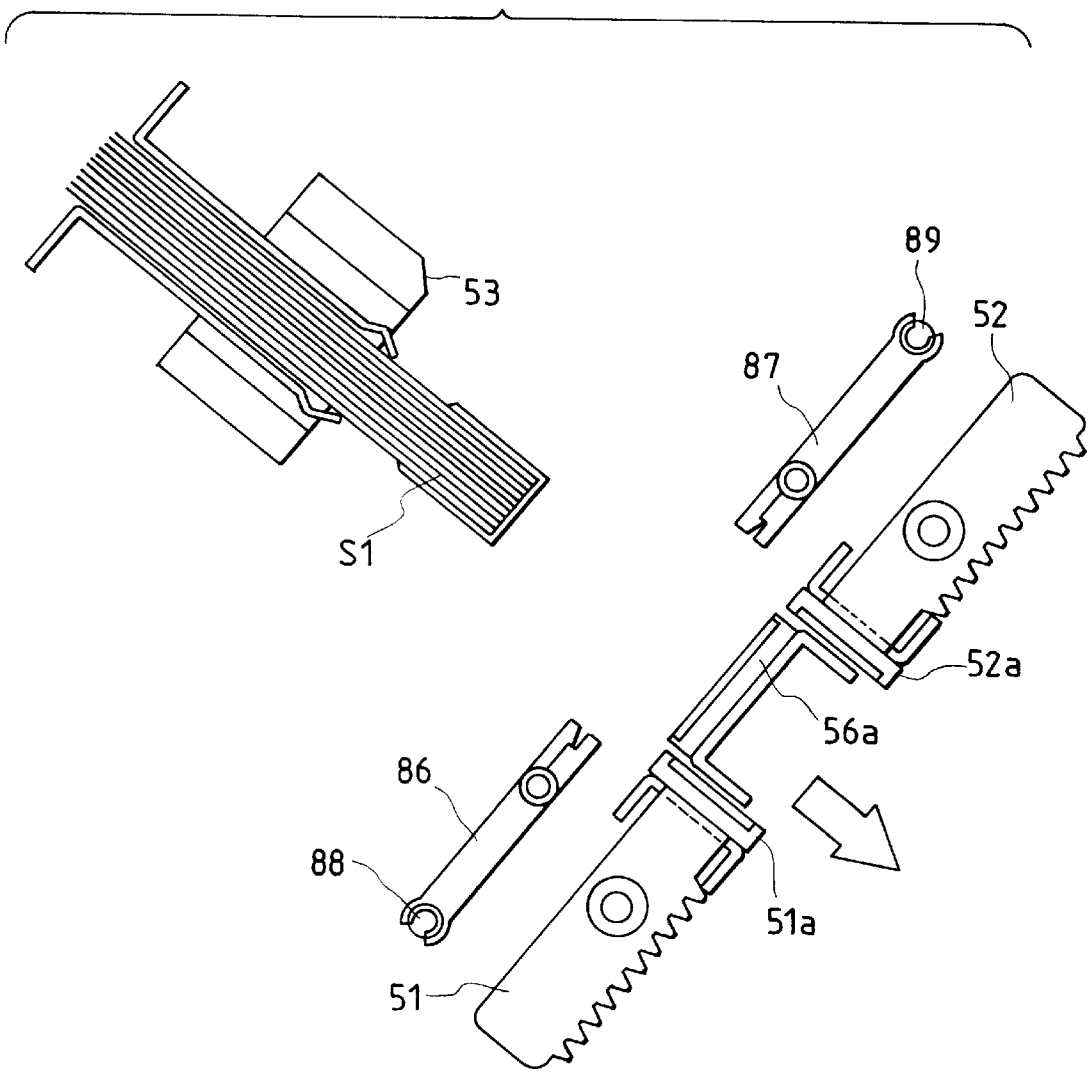
FIG. 15 is a longitudinal cross-sectional side view illustrating the operation of the tape heating device after the bookbinding has been completed and the retracting movement of the bundle of sheets.

The side heaters 51, 52 and the back heater 56*a* are returned to their retracted positions, as shown in FIGS. 14B and 15, in preparation for the supply of the next bind tape T1(or T2) when the completely bound article S1 is retracted from the back bearing position H.

Figure 16:
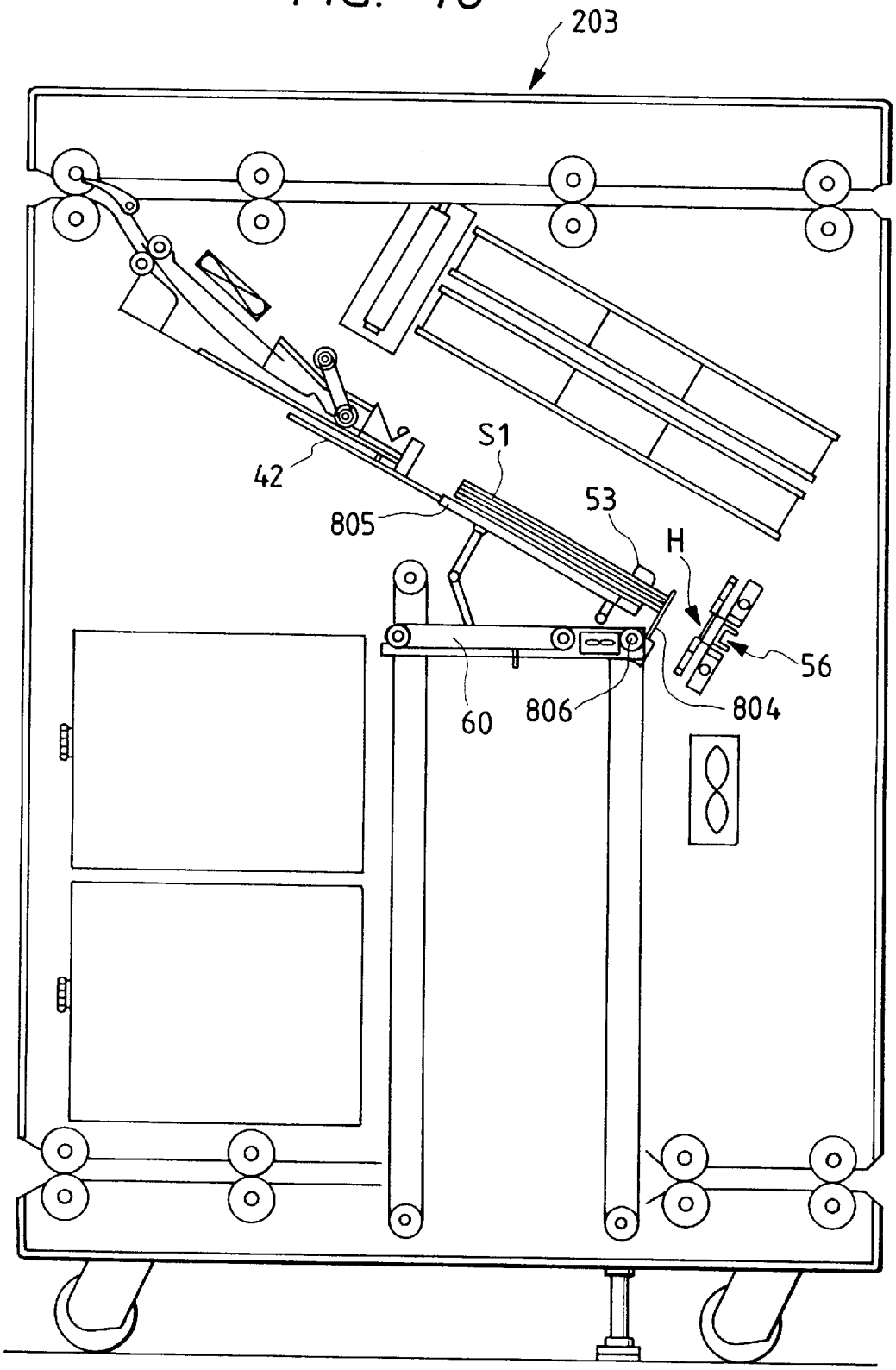
FIG. 16 is a longitudinal cross-sectional side view illustrating the operation when the completely bound article is delivered to the carriage.

FIG. 16 shows a state in which the completely bound article S1 being clamped by the clamp member 53 has been moved to the delivery position to the carriage 60 while the lower surface thereof is guided by the auxiliary guide plate 42. The sheet bundle supporting bar 805 in the carriage 60 is moved in the direction of arrow D indicated in FIG. 2 to support the lower surface of the sheet bundle S1 with the auxiliary guide plate 42 while the sheet bundle S1 is being bound at the back bearing position H.

After the completion of the bookbinding, the bound sheet bundle S1 is moved in the direction of arrow C indicated in FIG. 2 by the clamp member 53 and is spaced apart from the back bearing position H. Thereafter, the sheet bundle trailing end supporting plate 804 is moved between the raised end portion of the sheet bundle and the tape heating device 56 and supports the trailing end of the sheet bundle S1.

Figure 17:
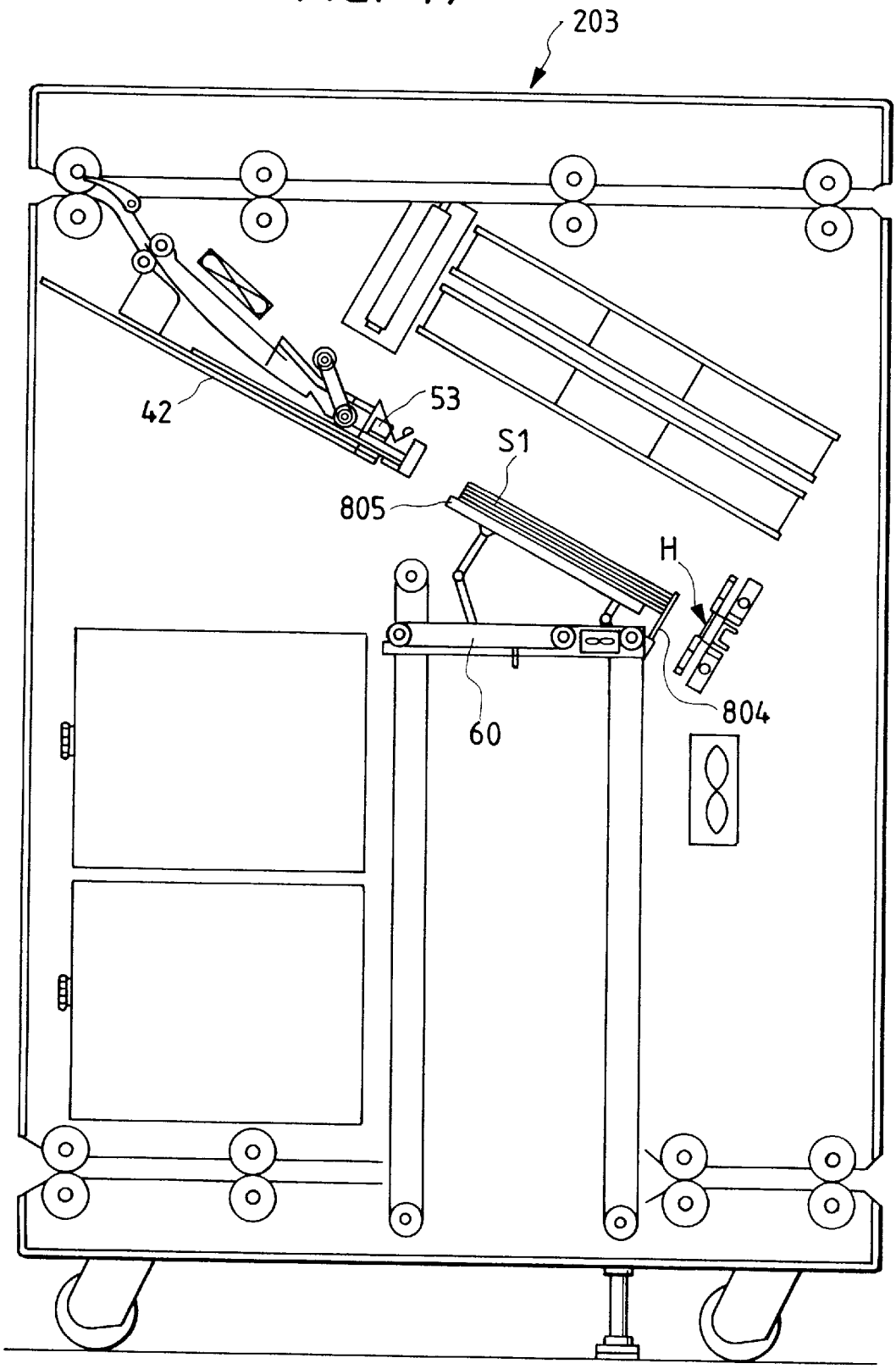
FIG. 17 is a longitudinal cross-sectional side view illustrating the operation when the completely bound article is delivered to the carriage.

FIG. 17 shows a state in which the clamp member 53 having released its clamping has been spaced apart from the sheet bundle S1. In this case, the sheet bundle supporting bar 805 is further moved in the direction of arrow D indicated in FIG. 2 and supports the lower surface of the sheet bundle S1 by itself alone. Thereafter, the clamp member 53 and the auxiliary guide plate 42 is returned toward the aligning tray 41. Thus, the sheet bundle S1 is raised upwardly from the position of movement of the auxiliary guide plate 42 by the sheet bundle supporting bar 805 and therefore, the clamp member 53 and the auxiliary guide plate 42 can be returned to the aligning tray 41 without rubbing against the lower surface of the sheet bundle. The auxiliary guide plate 42 and the sheet bundle supporting bar 805 are of comb-toothed shapes deviating relative to each other and are adapted to be entered into each other alternately.

Figure 18:
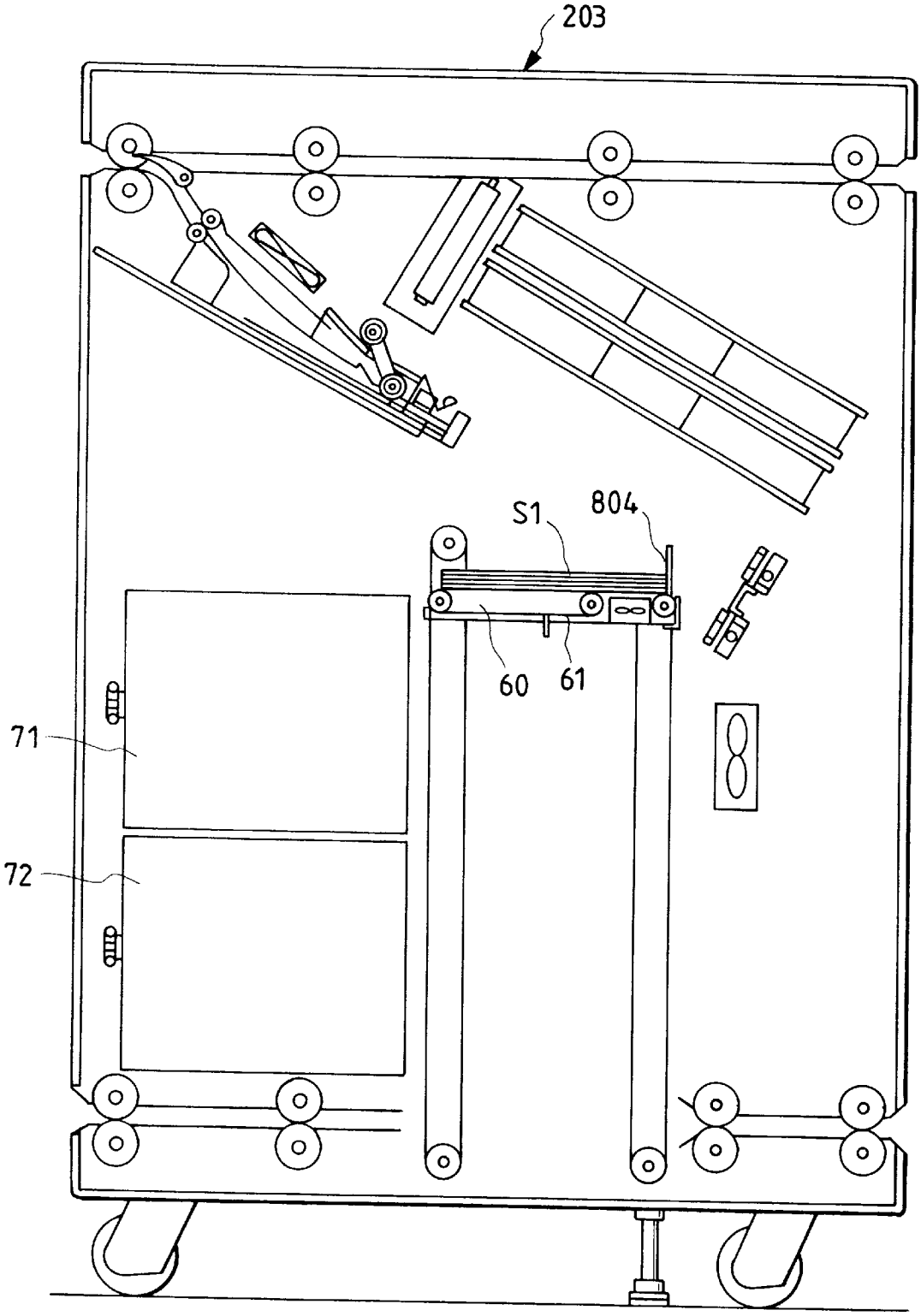
FIG. 18 is a longitudinal cross-sectional side view illustrating the operation when the completely bound article is delivered to the carriage.

When the clamp member 53 and the auxiliary guide plate 42 are returned to the aligning tray 41, the sheet bundle supporting bar 805 is lowered as shown in FIG. 18, whereby the completely bound article S1 lands on the conveying belt 803.

Figure 19:
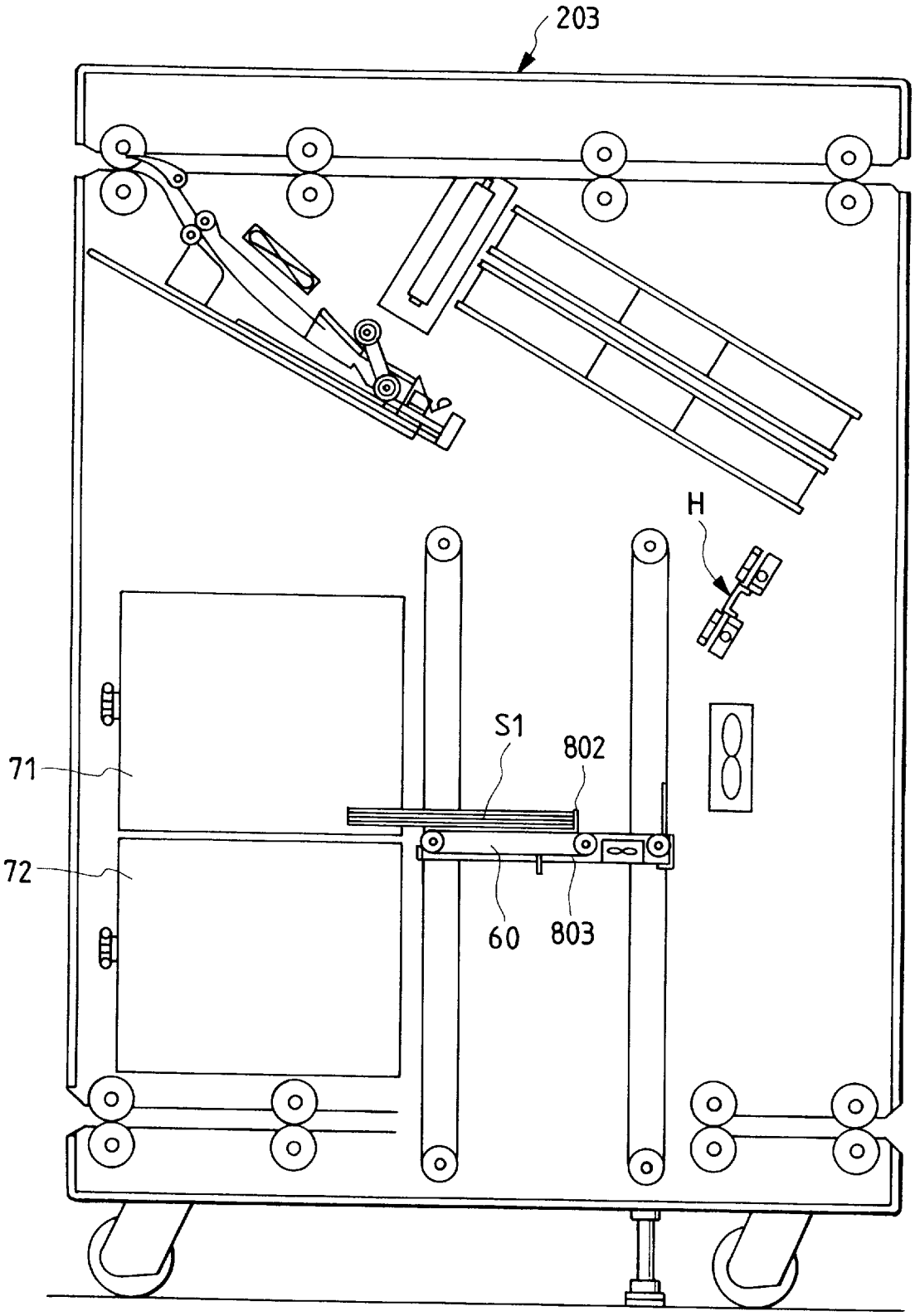
FIG. 19 is a longitudinal cross-sectional side view showing a state in which the completely bound article is being received into an upper stacker by the carriage.
Figure 20:
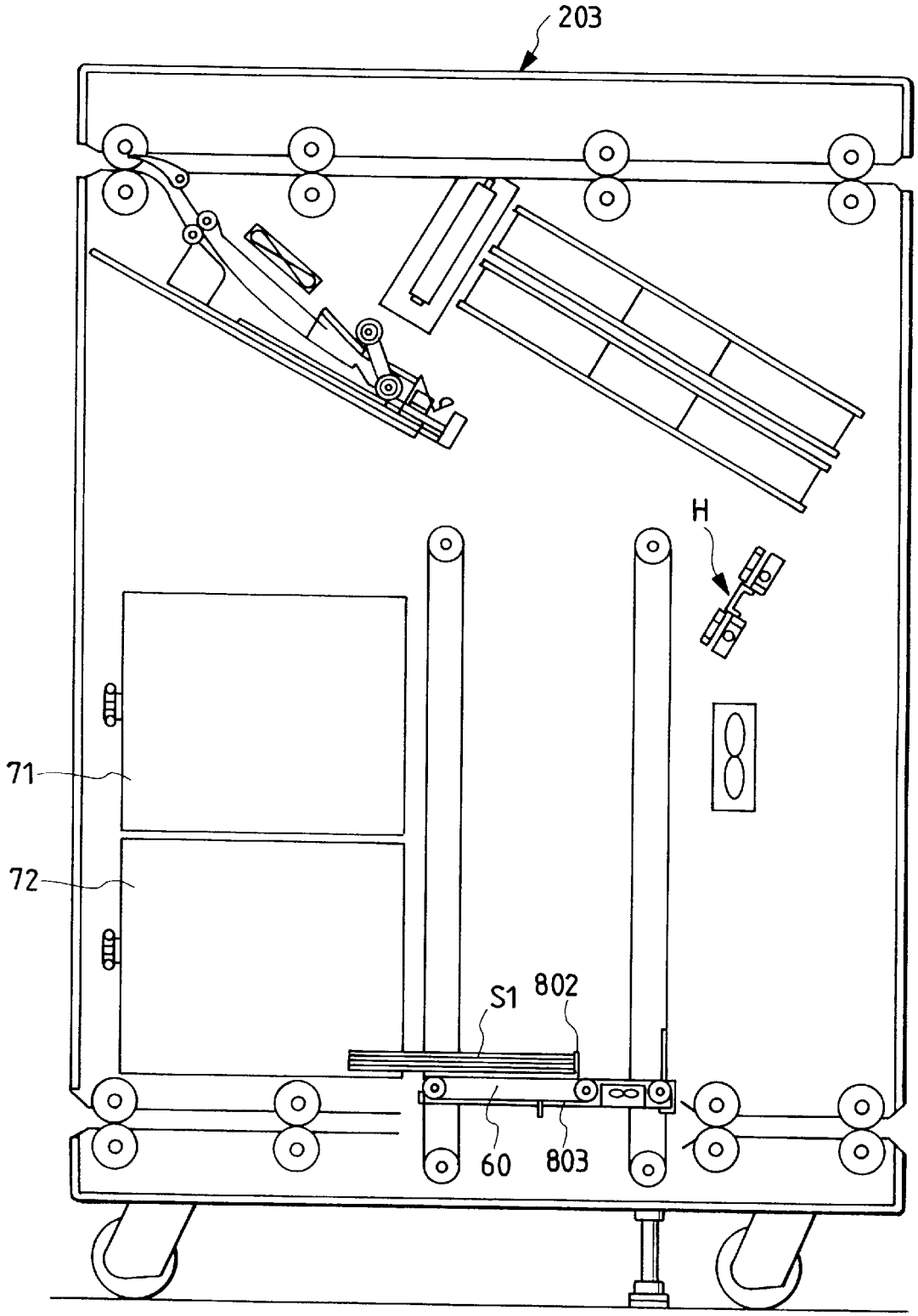
FIG. 20 is a longitudinal cross-sectional side view showing a state in which the completely bound article is being received into a lower stacker by the carriage.
Figure 21:
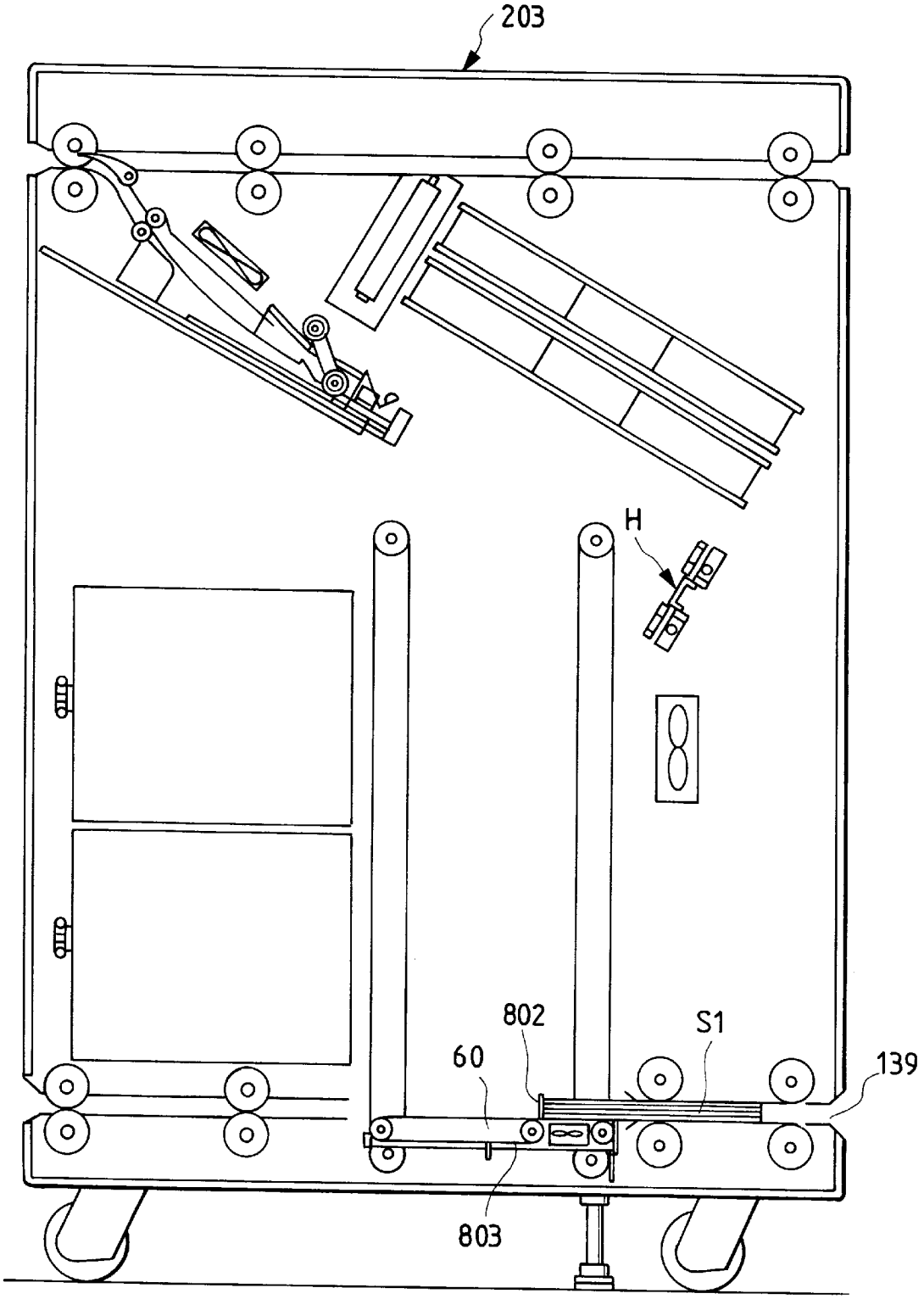
FIG. 21 is a longitudinal cross-sectional side view showing a state in which the completely bound article conveyed by the carriage is being discharged out of the apparatus.

FIGS. 19 and 20 show a state in which the completely bound articles S1 are being received into the stackers 71 and 72, respectively. The completely bound articles S1 on the carriage 60 are received into the stackers 71 and 72 by the conveying belt 803 and the trailing end pushing member 802. Also, when the completely bound articles S1 on the carriage 60 are not to be received into the stackers 71 and 72, the completely bound articles S1 are discharged out of the apparatus through a second discharge port 139, as shown in FIG. 21.

Figure 22:
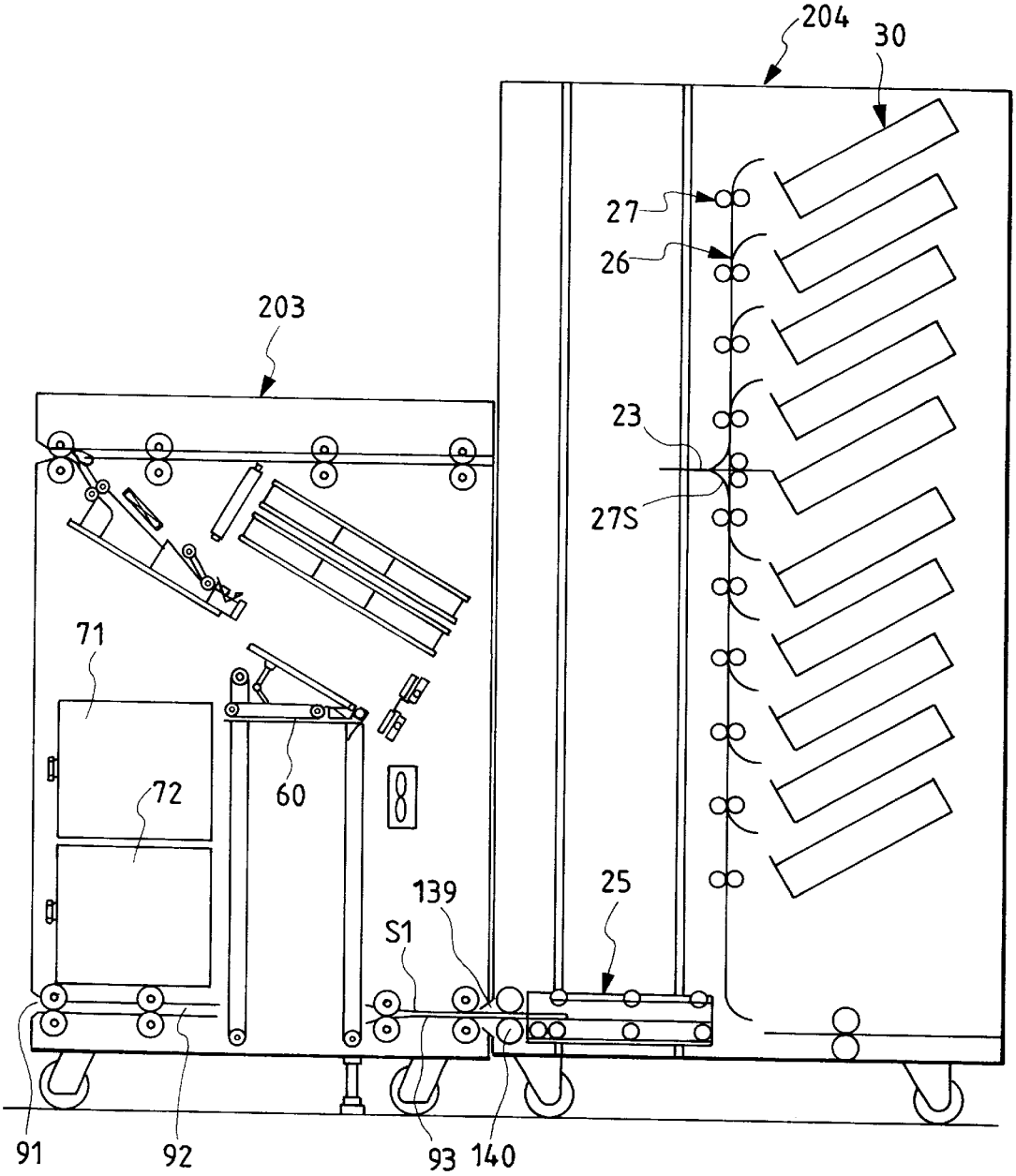
FIG. 22 is a longitudinal cross-sectional side view showing a state in which the completely bound article discharged out of the bookbinding apparatus is being delivered to the elevator of an assorting and containing apparatus.

In FIG. 22, the completely bound article S1 discharged from the bookbinding apparatus 203 is delivered to the elevator 25 in the lower portion of the sorting and containing apparatus 204, and is contained in the predetermined discharge tray 30 by the vertical movement of this elevator 25. Also, when the completely bound article S1 need not be contained in the discharge tray 30, it is intactly discharged out of the sorting and containing apparatus 204 via the elevator 25 which is then positioned at its lowermost position.

Also, when a sheet bundle not to be bound or a sheet is to be discharged from the body into the sorting and containing apparatus through the bookbinding apparatus, the carriage 60 is moved downwardly of the bookbinding apparatus 203. The sheet bundle not to be bound or the sheet enters through a second carry-in port 91 below the stacker 72 and is discharged from a second discharge port 139 through a left lower conveying path 92, the carriage 60 and a right lower conveying path 93. With such a construction, when the sheet bundle not to be bound is to be discharged out of the assorting and containing apparatus 204, it becomes possible to effect the discharge of the sheet bundle S1 and of the apparatus without the intermediary of the conveying pass 26 in the assorting and containing apparatus 204.

Figure 27:
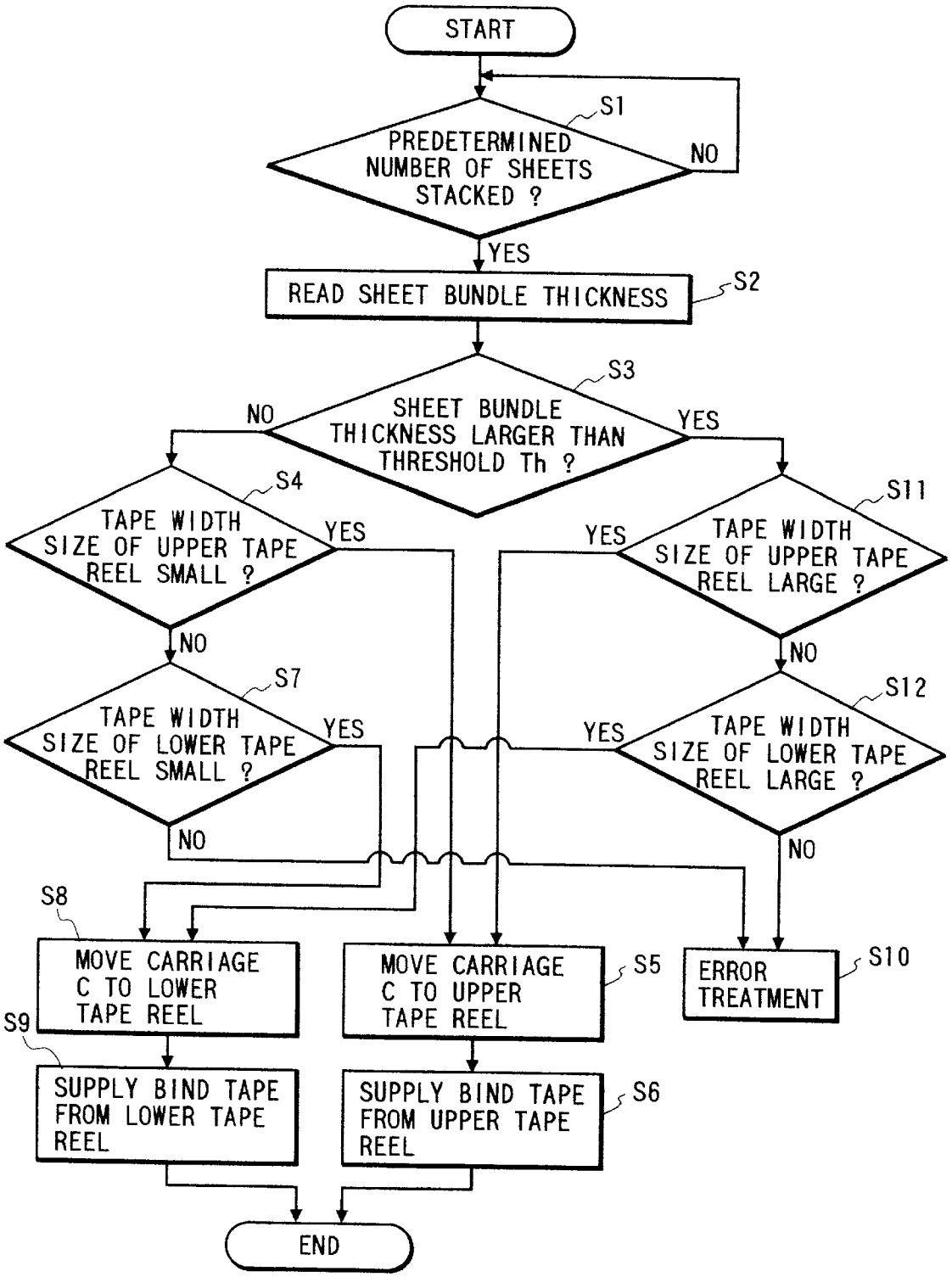
FIG. 27 is a flow chart showing an example of the operation of the CPU automatically selecting a bind tape to be supplied to a bookbinding portion from among a plurality of kinds of tape width sizes.

An example of the operation of the tape selecting means TS of the CPU automatically selecting a bind tape to be supplied to the bookbinding portion, from among a plurality of kinds of tape width sizes will now be described with reference to FIG. 27.

First, whether a predetermined number of sheets S have been stacked on the aligning tray 41 is checked (S1). If the predetermined number of sheets S have been stacked, thickness information memorized by the thickness memory means M is read out (S2).

Subsequently, whether the thickness read out from the thickness memory means MA is larger or smaller than a threshold value Th is checked (S3). If as a result, the thickness is smaller than the threshold value Th, whether the tape width size of the upper tape reel is a small size is first checked (S4). If it is a small size, the carriage C is moved to the upper tape reel (S5) and subsequently, the bind tape T1 is supplied from the upper tape reel, i.e., the tape reel 77A (S6).

If the result of the check at S4 is a large size, whether the tape width size of the lower tape reel is a small size is then checked (S7). If it is a small size, the carriage C is moved to the lower tape reel (S8) and subsequently, the bind tape T1 is supplied from the lower tape reel, i.e, the tape reel 77A.

If the result of the check-up at S7 is a large size, an error treatment such as displaying on the operating portion a message to the effect that for example, the tape reel 77A on which the bind tape T1 of a small width size is wound is not set is effected because both of the upper tape reel and the lower tape reel are tape reels 77B on which the bind tape T2 of a large width size is wound (S10). If the result of the comparison at S3 is greater than the threshold value Th, whether the tape width size of the upper tape reel is a large size is first checked (S11). If it is a large size, the carriage C is moved to the upper tape reel (S5) and subsequently, the bind tape T2 is supplied from the upper tape reel, i.e., the tape reel 77B (S6).

If the result of the check at S11 is a small size, whether the tape width size of the lower tape reel is a large size is then checked (S12), and if it is a large size, the carriage C is moved to the lower tape reel (S8) and subsequently, the bind tape T2 is supplied from the lower tape reel, i.e., the tape reel 77B (S9). If the result of the check at S12 is a small size, an error treatment such as displaying on the operating portion a message to the effect that for example, the tape reel 77B on which the bind tape T2 of a large width size is wound is not set is effected because both of the upper tape reel and the lower tape reel are tape reels 77A on which the bind tape T1 of a small width size is wound (S10).

In the present embodiment, the bind tape T1 of a small tape width size and the bind tape T2 of a large tape width size are provided so that the bind tape T1 may be used for thin sheet bundles and the bind tape T2 may be used for thick sheet bundles. But if bind tapes of more kinds of tape width sizes are provided, bookbinding can be accomplished by the use of bind tapes of tape width sizes better suited for the thicknesses of sheet bundles.

Also, when as in the present embodiment, bind tapes of two kinds of tape width sizes are provided and bookbinding is to be continuously effected a plurality of times, the tape width size selected during the first bookbinding is memorized and the bind tape of the memorized tape width size is also used during the second bookbinding and so on, whereby there will not occur the inconvenience that the tape width size used for sheet bundles of the same thickness differs due to the measurement error of the thickness of sheet bundles.

As described above, in the bookbinding apparatus of the present invention, a bind tape conforming to the thickness of a sheet bundle to be bound can be automatically selected from among tapes of a plurality of kinds of width sizes and can be supplied to the bookbinding portion. Therefore, the operator will not be troubled if the thickness of a sheet bundle to be bound changes. Also, a bind tape of a width size conforming to the thickness of a sheet bundle is used and therefore, it will not happen that the length of the margin to paste up adhesively secured to the front cover and the back cover becomes irregular depending on the thickness of a sheet bundle and the quality of bookbinding is reduced.

What is claimed is:

1. A bookbinding apparatus for binding a bundle of sheets by the use of a bind tape, comprising:

a plurality of bind tape supporting means for supporting a plurality of kinds of bind tapes differed in a tape width size;

width size information output means for outputting a width size information of the bind tape supported by each of said bind tape supporting means;

thickness information output means for outputting a thickness information of a bundle of sheets to be bound;

tape selecting means for selecting a bind tape of an optimum size capable of binding the bundle of sheets on the basis of the information from each of said width size information output means and said thickness information output means;

binding means for binding the bind tape selected by said tape selecting means and the bundle of sheets together; and width size memory means for memorizing a width size of the tape selected by said tape selecting means, wherein during a continuous mode for continuously effecting the bookbinding of a plurality of volumes, the second and subsequent binding operations are performed by the bind tape of the width size memorized by said width size memory means.

2. A bookbinding apparatus according to claim 1, wherein said width size information output means comprises width size detecting means for detecting a width size of the bind tape supported by each of said plurality of bind tape supporting means.

3. A bookbinding apparatus according to claim 2, wherein a mark for discriminating between the width sizes of the bind tapes supported by said bind tape supporting means is provided on said bind tape supporting means, and said width size detecting means reads the mark and outputs the width size information.

4. A bookbinding apparatus according to claim 1, wherein said thickness information output means comprises a thickness detecting means for detecting a thickness of the bundle of sheets to be bound.

5. A bookbinding apparatus according to claim 4, wherein said binding means is provided with a sheet bundle supporting portion for supporting the bundle of sheets, a binding portion for binding the bundle of sheets, and a clamp for conveying the bundle of sheets from said sheet bundle supporting portion to said binding portion, and said thickness detecting means detects the thickness of the bundle of sheets by a holding operation of said clamp for the bundle of sheets.

6. A bookbinding apparatus according to claim 1, further comprising width size information memory means for memorizing a width size information outputted from said width size information output means, wherein said tape selecting means selects the bind tape from the width size information memorized by said width size information memory means in conformity with the thickness information of the bundle of sheets from said thickness information output means.

7. A bookbinding apparatus according to claim 1, wherein said tape selecting means compares the width size information from said width size information output means with the thickness information from said thickness information output means and detects whether there is a bind tape of a proper width size for binding, and the bookbinding operation is discontinued when there is not a bind tape of a proper width size.

8. A bookbinding apparatus according to one of claims 1 to 7, wherein said binding means comprises heating means for melting an adhesive agent of the bind tape, and pressing means for bringing the bind tape into pressure contact with the bundle of sheets.

* * * * *

UNITED STATES PATENT AND TRADEMARK OFFICE

CERTIFICATE OF CORRECTION

PATENT NO. : 6,000,894

DATED : December 14, 1999

INVENTOR(S) : KATSUMARI SUZUKI, ET AL.

It is certified that error appears in the above-identified patent and that said Letters Patent is hereby corrected as shown below:

Title Page

IN THE ABSTRACT [57]

Line 4, "and are" should read --are--; and
Line 5, "means" should readf --a means--.

COLUMN 1,

Line 56, "tape" should read --tapes--; and
Line 57, "tapes" should read --tape--.

COLUMN 6,

Line 16, "great" should read --large/--;
Line 18, "small" should read --small/--;
Line 29, "select" should read --selects--; and
Line 62, "arrows" should read --the arrows--.

COLUMN 7,

Line 35, delete "the lead several", and
Line 49, "with to" should read --with--.

UNITED STATES PATENT AND TRADEMARK OFFICE

CERTIFICATE OF CORRECTION

PATENT NO. : 6,000,894

DATED : December 14, 1999

INVENTOR(S) : KATSUMARI SUZUKI, ET AL.

It is certified that error appears in the above-identified patent and that said Letters Patent is hereby corrected as shown below:

COLUMN 8,
Line 8, "S1de" should read --Side--;
Line 11, "Take" should read --Tape--; and
Line 44, "the both" should read --both--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*